US008251050B2

(12) United States Patent
Christopher et al.

(10) Patent No.: US 8,251,050 B2
(45) Date of Patent: Aug. 28, 2012

(54) MAGNETIC DRIVE BYPASS SYSTEM FOR PAINTBALL LOADER

(75) Inventors: James T. Christopher, Sachse, TX (US); Simon Benjamin Stevens, Sewell, NJ (US); Chris Goddard, Aubrey, TX (US)

(73) Assignee: KEE Action Sports I LLC, Sewell, NJ (US)

( * ) Notice: Subject to any disclaimer, the term of this patent is extended or adjusted under 35 U.S.C. 154(b) by 487 days.

(21) Appl. No.: 12/171,956

(22) Filed: Jul. 11, 2008

(65) Prior Publication Data

US 2009/0133680 A1 May 28, 2009

Related U.S. Application Data

(63) Continuation-in-part of application No. 11/548,588, filed on Oct. 11, 2006, now Pat. No. 7,832,389.

(60) Provisional application No. 60/949,137, filed on Jul. 11, 2007, provisional application No. 60/725,395, filed on Oct. 11, 2005.

(51) Int. Cl.
*F41B 11/02* (2006.01)

(52) U.S. Cl. ..... 124/51.1

(58) Field of Classification Search ..... 124/51.1
See application file for complete search history.

(56) References Cited

U.S. PATENT DOCUMENTS

| | | | |
|---|---|---|---|
| 1,743,576 | A | 1/1930 | Smith |
| 3,384,354 | A | 5/1968 | Albrecht et al. |
| 3,807,379 | A | 4/1974 | Vodinh |
| 4,027,646 | A | 6/1977 | Sweeton |
| 4,116,192 | A | 9/1978 | Scott |
| 4,207,857 | A | 6/1980 | Balka, Jr. |
| 4,502,455 | A | 3/1985 | Stokes |
| 4,759,435 | A | 7/1988 | Cedrone |
| 4,765,223 | A | 8/1988 | Beckmann |
| 4,817,955 | A | 4/1989 | Hickson et al. |
| 5,282,454 | A | 2/1994 | Bell et al. |
| 5,791,325 | A | 8/1998 | Anderson |
| 5,816,232 | A | 10/1998 | Bell |
| 5,947,100 | A | 9/1999 | Anderson |
| 5,954,042 | A | 9/1999 | Harvey |
| 6,109,252 | A | 8/2000 | Stevens |
| 6,206,562 | B1 | 3/2001 | Eyraud et al. |
| 6,213,110 | B1 | 4/2001 | Christopher et al. |

(Continued)

FOREIGN PATENT DOCUMENTS

DE 876370 5/1953

(Continued)

OTHER PUBLICATIONS

WARPIG—World and Regional Paintball Information Guide, http://www.warpig.com/paintball/technical/loaders/halo/index.shtml, warpig.com, Odyssey Readies Halo for Production, by Bill Mills, Jun. 2001, pp. 1 to 5.

(Continued)

*Primary Examiner* — John Ricci
(74) *Attorney, Agent, or Firm* — Volpe and Koenig, P.C.

(57) ABSTRACT

A drive system for a regulating the rotation of a drive system or agitator in a paintball loader is disclosed. It is designed to regulate the rotation of a feeder, especially during a jam or when projectiles in a hopper become misaligned. This allows a user to quickly and effectively clear a jam and resume or continue rapid fire without damaging projectiles, the loader or the paintball marker.

14 Claims, 35 Drawing Sheets

U.S. PATENT DOCUMENTS

| | | | |
|---|---|---|---|
| 6,305,367 | B1 | 10/2001 | Kotsiopoulos |
| 6,467,473 | B1 | 10/2002 | Kostiopoulos |
| 6,502,567 | B1 | 1/2003 | Christopher et al. |
| 6,520,854 | B1 | 2/2003 | McNally |
| 6,701,907 | B2 | 3/2004 | Christopher et al. |
| 6,739,323 | B2 | 5/2004 | Tippmann, Jr. |
| 6,792,933 | B2 | 9/2004 | Christopher et al. |
| 6,889,680 | B2 | 5/2005 | Christopher et al. |
| 6,915,792 | B1 | 7/2005 | Sheng |
| 7,021,302 | B2 | 4/2006 | Neumaster |
| 7,040,505 | B2 | 5/2006 | Hashimoto et al. |
| 7,222,617 | B2 | 5/2007 | Andresen |
| 7,357,129 | B2 | 4/2008 | Neumaster et al. |
| 7,357,130 | B2 | 4/2008 | Broersma |
| 7,428,899 | B2 | 9/2008 | Andresen |
| 7,445,002 | B2 | 11/2008 | Christopher et al. |
| 7,568,478 | B2 | 8/2009 | Hedberg |
| 7,654,255 | B2 | 2/2010 | Spicer |
| 7,832,389 | B2 | 11/2010 | Christopher |
| 7,921,835 | B2 | 4/2011 | Campo et al. |
| 2004/0074487 | A1 | 4/2004 | Christopher et al. |
| 2004/0074489 | A1 | 4/2004 | Neumaster et al. |
| 2004/0211402 | A1 | 10/2004 | Christopher et al. |
| 2006/0086347 | A1 | 4/2006 | Hedberg |
| 2006/0196489 | A1 | 9/2006 | Campo |
| 2006/0249131 | A1 | 11/2006 | Broersma |
| 2007/0017494 | A1 | 1/2007 | Andresen |
| 2007/0056573 | A1 | 3/2007 | Campo |
| 2007/0113834 | A1 | 5/2007 | Spicer |
| 2007/0137631 | A1 | 6/2007 | Christopher |
| 2008/0141990 | A1 | 6/2008 | Andresen |
| 2009/0133680 | A1 | 5/2009 | Christopher et al. |

FOREIGN PATENT DOCUMENTS

| | | |
|---|---|---|
| DE | 2035097 | 8/1982 |
| DE | 3721527 | 1/1989 |
| DE | 4343870 | 6/1994 |
| DE | 19922589 | 12/2000 |
| EP | 0075970 | 4/1983 |
| EP | 01054228 | 11/2000 |
| EP | 01653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6325233 | 11/1994 |
| WO | 98/13660 | 4/1998 |
| WO | 01/44745 | 6/2001 |
| WO | 02/42708 | 5/2002 |
| WO | 03087698 | 10/2003 |
| WO | 2007/035601 | 3/2007 |
| WO | 2007033309 | 3/2007 |
| WO | 2007044546 | 4/2007 |
| WO | 2007044822 | 4/2007 |
| WO | 2008104061 | 4/2008 |

OTHER PUBLICATIONS

WARPIG—World and Regional Paintball Information Guide, http://www.warpig.com/paintball/technical/loaders/halo/review.shtml, warpig.com, Odyssey Halo by Bill Mills, Dec. 2001, pp. 1 to 7.

Odyssey Halo B Paintball Hooper Review, http://www.paintball-gun-review.com/hopper-reviews/odyssey-halo-b...., Paintball Gun Review, Odyssey Halo B Paintball Hopper Review, 2004 Paintball-Gun-Review.com, pp. 1 to 4.

www.Odysseypaintball.com, http://web.archive.org/web/20030205112543/http://www.odysseypain...., Odyssey Paintball Products, Understanding Halo B, pp. 1 to 3.

Claimants' Response to KEE's Request for Disclosure (2 pages).

Claimants' Second Supplemental Response to KEE's Reqeust for Disclosure and Reply to KEE's Amended Response to Request for Disclosure (2 pages).

Claimants' Fourth Supplemental Response to KEE's Request for Disclosure (2 pages).

Respondents Second Amended Responses to Claimants' Request for Disclosure (2 pages).

Respondent'S Third Amended Responses to Claimants' Request for Disclosure (2 pages).

WARPIG—World and Regional Paintball Information Guide, http://www.warpig.com/paintball/technical/loaders/evlution/evlution . . . eVLution 2 Sneak Preview, by Bill Mills, Aug. 2001, p. 1 to 4.

WARPIG—World and Regional Paintball Information Guide, http://www.warpig.com/paintball/technical/loaders/evlution/index.shtml Brass Eagle's eVLution Loader, by Bill Mills, Aug. 2000, pp. 1 to 7.

WARPIG—World and Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 4.

MAGNETIC DRIVE BYPASS SYSTEM FOR PAINTBALL LOADER

CLAIM OF PRIORITY

This application claims priority from and the benefit of U.S. Provisional Patent Application No. 60/949,137, filed Jul. 11, 2007, and is a continuation-in-part of U.S. patent application Ser. No. 11/548,588, filed Oct. 11, 2006, which claims priority from U.S. Provisional Patent Application No. 60/725,395, filed Oct. 11, 2005, the entire contents of all of which are incorporated by reference herein.

FIELD OF INVENTION

This invention relates to the field of projectile loaders for feeding projectiles to, for example, compressed gas guns. Specifically, the present invention relates to an improved drive system for a paintball loader, and a paintball incorporating the improved drive system.

BACKGROUND

Paintball, a popular sport has developed over the years, which uses paintball markers (guns), which are guns utilizing compressed gas to fire projectiles. Some examples of paintball guns are those offered under the brand names 32 DEGREES™, EMPIRE™, DIABLO™, BT™ and INVERT MINI™, and others shown and described in U.S. Pat. Nos. 6,708,685; 4,936,282; 5,497,758; and U.S. application Ser. Nos. 11/183,548; 11/180,506; 11/150,002; 11/064,693; 10/313,465; 10/090,810, the entire contents of which are all incorporated fully herein by reference. Players use the paintball guns to shoot projectiles known as paintballs (projectiles and paintballs are used interchangeably herein). These paintballs are spherical, frangible projectiles normally having gelatin or starch-based shells filled with paint (coloring or dye). The shells break when impacting a target, allowing the paint within to splatter on the target. The sport of paintball is often played like capture the flag. A player is eliminated from the game when the player is hit by a paintball fired from an opposing player's marker. When the paintball hits a target such as a player, a mark or "splat" of paint is left on the player.

Paintball loaders (otherwise known as hoppers or magazines, and also referred to herein as "projectile loaders" or "loaders") generally sit atop the markers and feed projectiles into the marker. These projectile loaders (the terms "hopper," "magazine," and "loader" are used interchangeably herein) store projectiles, and have an outlet or exit tube (outfeed tube or neck). The outlet tube is connected to an inlet tube (or feed neck) of a paintball marker, which is in communication with the breech of the paintball marker. Thus, the loaders act to hold and feed paintball projectiles into the breech of a paintball marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other mechanism, such as those shown and described in U.S. Pat. Nos. 6,213,110; 6,502,567; 5,947,100; 5,791,325; 5,954,042; 6,109,252; 6,889,680; and 6,792,933, the entire contents of which are incorporated by reference herein. In a "gravity feed" or "agitating" loader, an agitator mixes projectiles so that no jams occur at the exit opening of the outlet tube. In a "force feed" or "active feed" paintball loader, the agitator (drive cone, carrier, paddle or any other force feed drive system) forces projectiles through the exit tube. Because it is desirable to eliminate as many opposing players as possible, paintball markers are capable of semi-automatic rapid fire. Accordingly, the paintball loaders act to hold a quantity of projectiles, and ensure proper feeding, and feed rate of the projectiles to the marker for firing.

Modern paintball loaders utilize projections, paddles, arms, carriers, drive cones, or other agitators to mix or advance paintballs. These agitators are operated by motors, which are usually electrical and powered by a power source such as a battery.

One critical problem with current paintball loaders is when such loaders and the agitators in such loaders encounter a jammed paintball (such as when a paintball is jammed such as at an exit opening or cannot otherwise move), paintball breakage can occur. In addition, the motors may be damages if they cannot operate or become jammed.

Thus, there is the need for a paintball loader that can continue to operate, even when a paintball jam occurs, and that will not break paint or damage the motor of a paintball agitator when encountering a jam or other disruption in operation.

SUMMARY

The present invention is directed to a drive system for a paintball loader comprising a drive shaft rotatable about a central axis, a drive mechanism rotatable about a drive shaft, the drive mechanism including a first magnetic surface, a feed mechanism carrier adjacent the drive mechanisms including at least one magnetically attractable portion that is attractable to the magnet of the drive mechanism.

In another embodiment, the present invention is directed to a drive system for a paintball loader comprising a drive shaft rotatable about a central axis, a drive mechanism attached to the drive shaft, the drive mechanism having a magnetically attractable portion, a feed mechanism carrier attachable to a feeder adjacent the drive mechanism and rotatable about the drive shaft, the feed mechanism carrier having at least one magnet that is attractable to the magnetically attractable portion of the drive mechanism.

In another embodiment, the present invention is directed to a drive system for a paintball loader comprising a drive shaft rotatable about a central axis, having a magnet attached thereto, the drive shaft extending vertically through a hole in a feed mechanism carrier that is rotatable about the drive shaft, wherein the feed mechanism carrier has at least one magnetically attractable portion that is attractable to the magnet of the drive shaft.

In another embodiment, the present invention is directed to a drive system for a paintball loader comprising a drive shaft rotatable about a central axis, having a magnetically attractable portion attached thereto, the drive shaft extending vertically through a hole in a feed mechanism carrier attachable to a feeder, the feed mechanism carrier rotatable about the drive shaft and having at least one magnet that is attractable to the magnetically attractable portion of the drive shaft.

In another embodiment, the present invention is directed to a drive system for a paintball loader comprising a drive shaft rotatable about a central axis, a feed mechanism carrier connected to the drive shaft, the feed mechanism carrier having at least one sloped upper portion and a spring attached thereto, the feed mechanism carrier in contact with a feeder, a spring attached to the feeder, the spring contained and moveable within a spring guide.

The present invention is further directed to a drive mechanism for a paintball loader, the loader having a feed mechanism including a first plate which rotates with a drive shaft of the paintball loader, the first plate having a magnetic or magnetically attractable portion. The feed mechanism also including a second plate magnetically attractable to the magnetic or magnetically attractable portion of the first plate. The second plate is in communication with a feeder that rotates independently of the drive shaft.

In another embodiment, the present invention is a drive system for a paintball loader comprising a drive shaft rotatable about a central axis, a feed mechanism carrier connected to the drive shaft, the feed mechanism comprising a separate cover or cap for the feed mechanism carrier having at least one sloped upper portion. The feed mechanism carrier having a spring abutment which abuts an end of the spring, the feed mechanism carrier is also in contact with a spring housing coupled to the feeder, the spring contained and moveable within the spring housing.

DETAILED DESCRIPTION OF THE PREFERRED EMBODIMENTS

As used herein, the term "binding element" refers to either a magnet or a magnetically attractable element. As used herein, a "magnetically attractable element" can be any element that is attracted to a magnet including, but not limited to, ferromagnetic materials such as iron, nickel, cobalt, neodymium, etc. As used herein, the terms "feeder", "feed mechanism", or "impeller" are used interchangeably to refer to any apparatus that impels, moves, pushes, agitates, or otherwise mixes projectiles within a loader or hopper, such as an agitator, arms, fins, paddles, paddle arms, spokes, drive cones, carriers, including, but not limited to, those shown and described in U.S. Pat. Nos. 6,213,110; 6,502,567; 5,947,100; 5,791,325; 5,954,042; 6,109,252; 6,889,680; and 6,792,933, the entire contents of which are incorporated by reference herein, and those used in commercially available paintball loaders such as the various HALO® brand paintball loaders, the EMPIRE RELOADER™ paintball loaders, and any substitutes or equivalents thereof.

Figure 1:
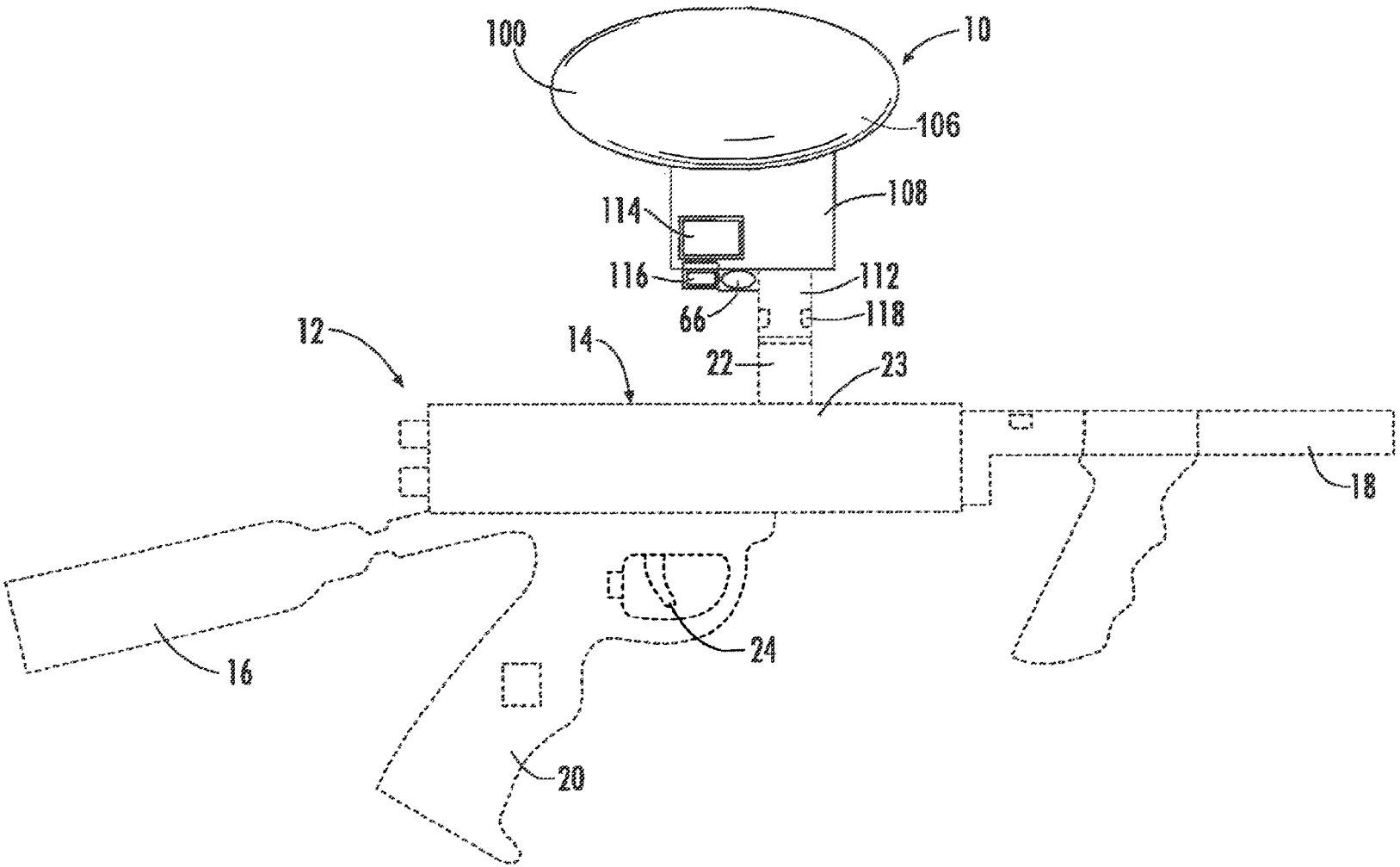
FIG. 1 is a side elevation view of an illustrative paintball loader operatively attached to a paintball marker illustrated in phantom.

FIG. 1 is a side elevational view of a paintball loader 10 attached to a representative paintball gun 12 (illustrated in phantom). The paintball gun 12 includes a main body 14, a compressed gas cylinder (gas tank) 16, a barrel 18, and a grip portion 20. The paintball gun also includes an inlet tube 22 (also called a feed neck) leading to a firing chamber 23 (or breech) in the interior of the main body 14, and a trigger 24. The compressed gas cylinder 16 is typically secured to a rear portion of the paintball gun 12. The compressed gas cylinder normally contains $CO_2$ or $NO_2$, although any compressible gas may be used.

Figure 2:
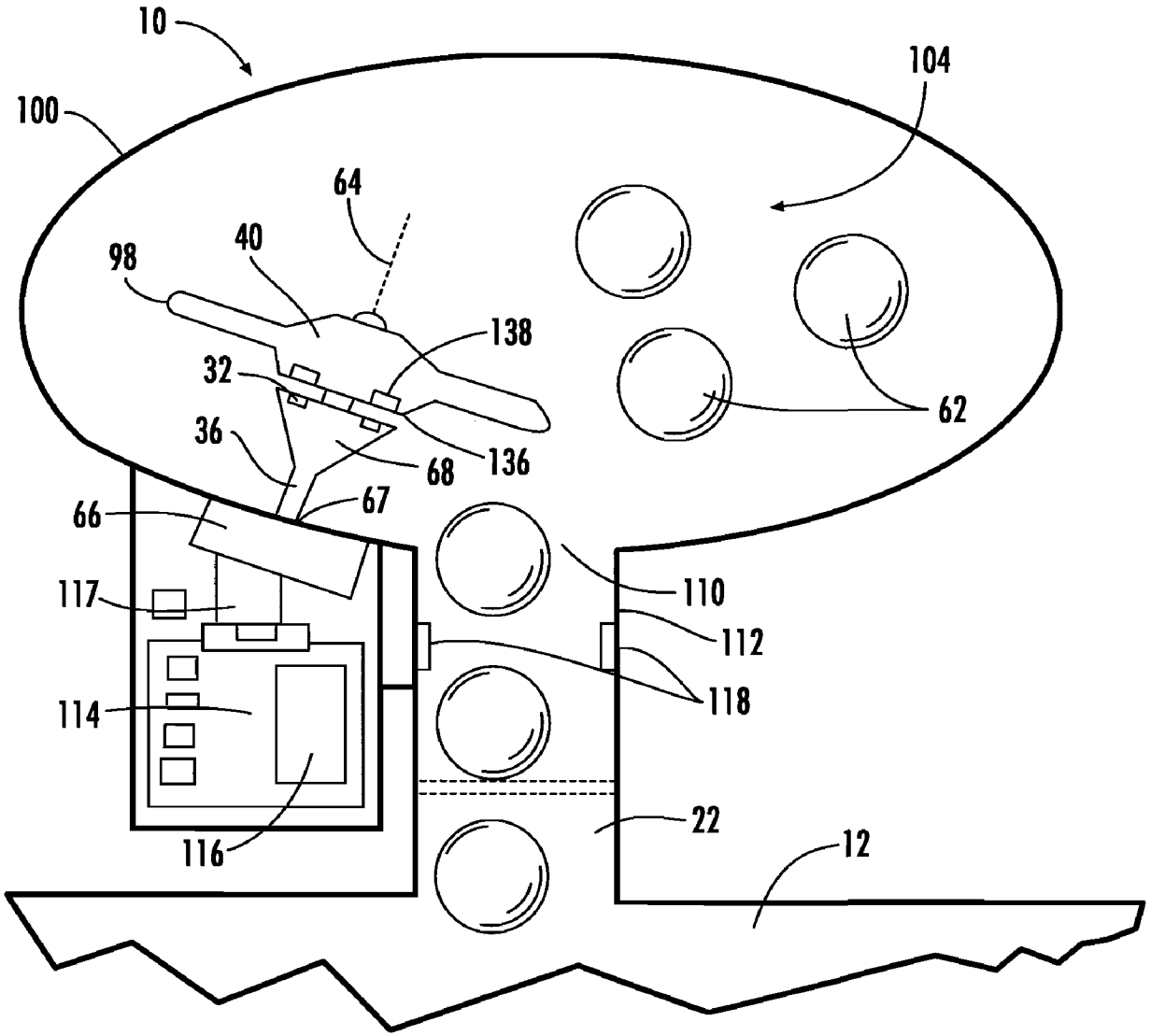
FIG. 2 is a side cross sectional view of an embodiment of an illustrative paintball loader according to the present invention.

An exemplary paintball loader 10 is shown in more detail in FIGS. 1-2. The paintball loader 10 includes a loader body 100 forming an interior area 104. The loader body 100 may be divided into an upper portion 106 and a lower portion 108. Generally, an exit portion 110, such as an opening, leads from the lower portion 108 of the loader body 100 to an outfeed tube 112, although the exit portion 110 may be positioned at another location in the loader body 100. The exit portion 110 is positioned adjacent the inlet tube 22 of the compressed gas gun 12. The paintball loader 10 includes a motor 66. The motor 66 may be in communication with a controller 114 and/or microprocessor 116 for controlling at least one operation of the loader 10. In addition, at least one sensor 118 may be provided in communication with the motor 66, controller 114 and/or microprocessor 116, or any combination of those, for detecting the presence or absence of projectiles 62 in the exit portion 110 or outfeed tube 112 of the loader 10, or positioned at other locations within or about the loader body 100. A power source such as a battery 117 may be provided for powering the motor 66, controller 114, microprocessor 116, or any combination thereof.

Figure 3:
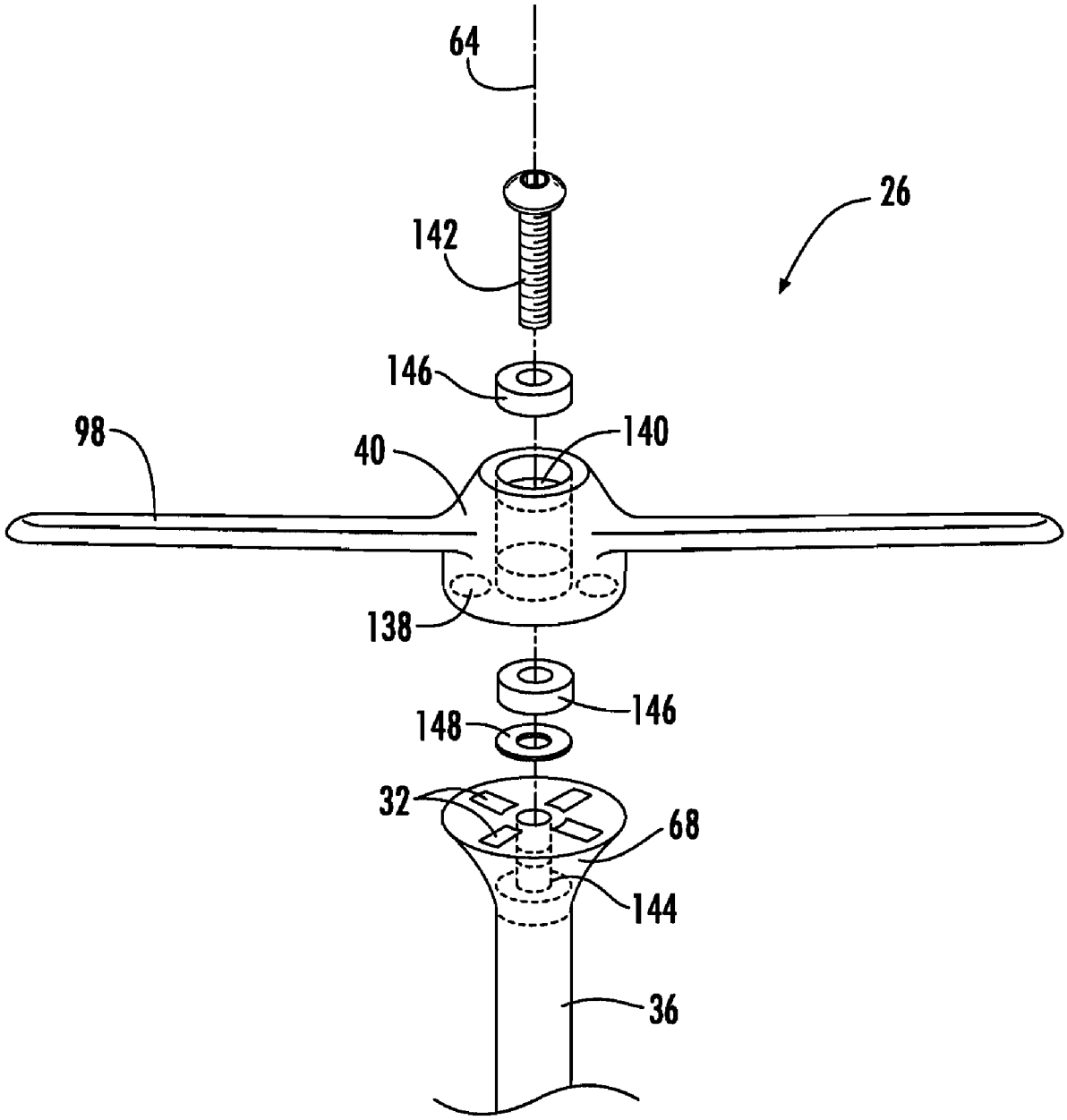
FIG. 3 is an exploded isometric view of a first embodiment of a drive mechanism for a paintball loader according to the present invention.

A first embodiment of a drive mechanism for a paintball loader according to the present invention is shown in FIGS. 2-3. A drive mechanism 26 according to an embodiment of the present invention includes a drive shaft 36 that rotates about a central axis 64. The drive shaft 36 is coupled at its first end 67 to a motor 66 for rotating the drive shaft 36, which may be an electrical motor, a stepper motor, a wind up or spring operated motor, or any other means for rotating or otherwise operating the drive mechanism 26. The second end or upper portion 68 of the drive shaft 36 includes at least one binding element 32. In the preferred embodiment, the binding element 32 is a magnet or a magnetically attractable insert, such as a ferrous metal, or other metal attracted to a magnet.

As shown in greater detail in FIG. 3, the feed mechanism 40 is positioned adjacent the second end or upper portion 68 of the drive shaft 36. The feed mechanism 40 may include arms 98 (fins, paddles, or other extensions) such as shown in FIGS. 2-3, adapted for mixing or moving paintballs contained with a paintball loader 10. The feed mechanism 40 includes a lower portion 136 including at least one second binding element 138. The second binding element 138 may be a magnet of different polarity as the binding element 32 (if the binding element 32 is a magnet), or may be a magnetically attractable insert (if the binding element 32 is a magnet), or may be a magnet of any polarity (if the binding element 32 is a magnetically attractable insert).

The feed mechanism 40 includes an opening 140 for receiving a screw 142. The screw 142 is preferably sized smaller than the opening 140, and is received in a threaded opening 144 in the upper portion 68 of the drive shaft 36. In this arrangement, the feed mechanism 40 is free to rotate about the screw 142. A bushing (or bearing) 146 and/or washer 148 may be provided for assisting free rotation of the feed mechanism 40. It is appreciated that a thinner diameter portion extension of the drive shaft 36 may extend though the opening 140, and may be affixed in place with a screw or other connection means.

When the motor 66 operates the drive shaft 36, the drive shaft 36 will rotate in either a clockwise or counterclockwise direction about the central axis 64. The binding element 32 and second binding element 138 will have a magnetic attraction to each other. Thus, when the drive shaft 36 rotates, the binding element 32 will impart (or have imparted upon it) a magnetic force (adhesion force) on the second binding element 138, that will rotate in tandem the feed mechanism 40 when there are no jammed paintballs in the paintball loader 10.

If a paintball jam is encountered, or if the paintballs cannot be agitated or otherwise moved for some reason, the drive shaft 36 will continue to rotate. With the feed mechanism 40 unable to continue rotation, the binding element 32 will rotate past the second binding element 138 of the feed mechanism 40 when the force of the motor 66 on the drive shaft 36 cannot overcome the force holding the feed mechanism 40 in place. In this manner, the motor 66 will not be damaged, and the feed mechanism 40 will not be forced to break or otherwise rupture paintballs that cannot be agitated.

Figure 4:
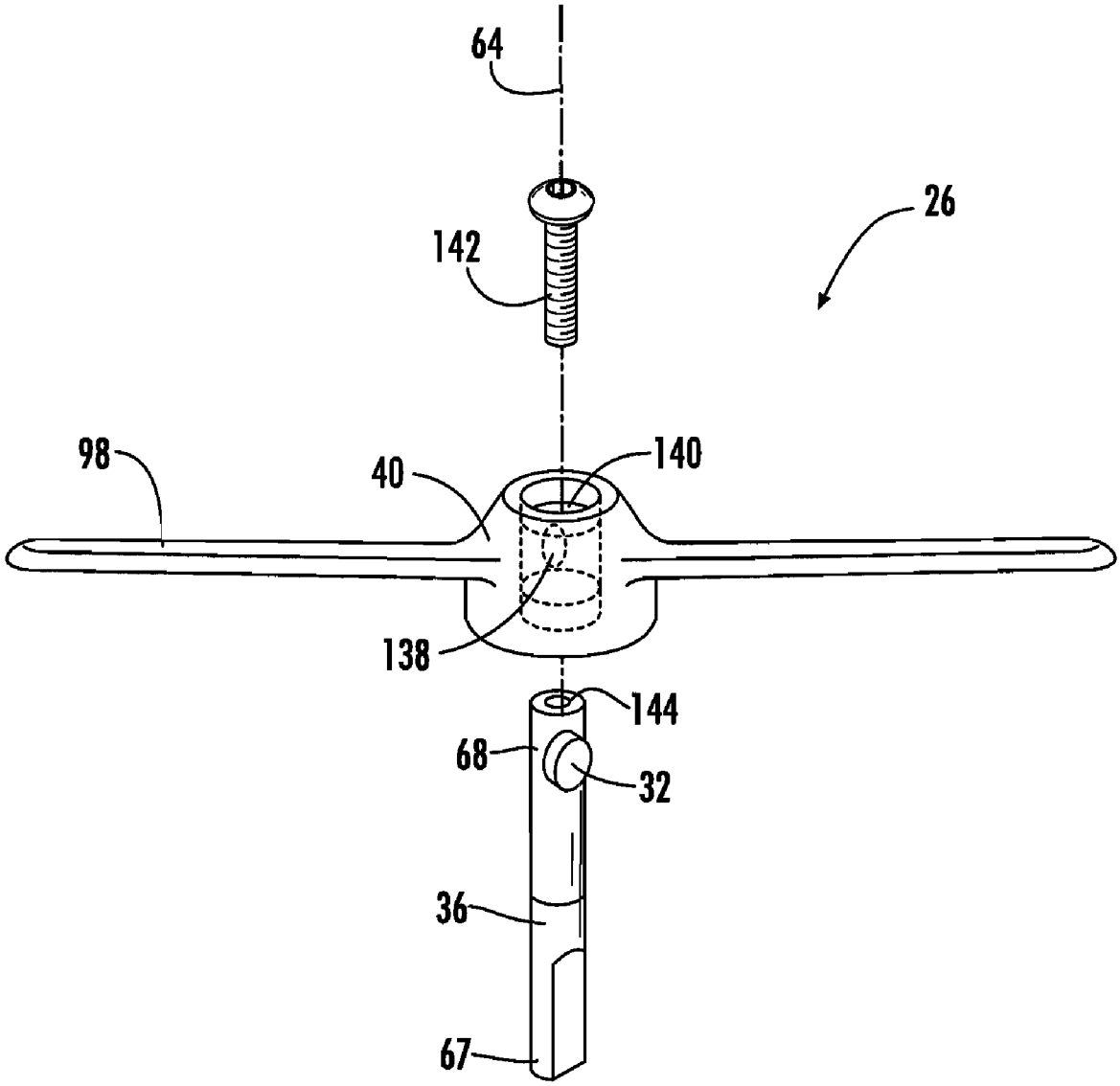
FIG. 4 is an exploded isometric view of a second embodiment of a drive mechanism for a paintball loader according to the present invention.

Accordingly, the present invention provides for a magnetic clutch system. When the drive shaft 36 continues to rotate, the binding element 32 will again come into proximity to the second binding element 138. The binding element 32 and second binding element 138 can be positioned at any location on or about the drive shaft 36 or the feed mechanism 40 to permit the binding element 32 and second binding element 138 to come into proximity and be in position so that a magnetic attraction occurs between the binding element 32 and second binding element 138. As shown in FIG. 4, a binding element 32 may be positioned or otherwise formed in a side wall 150 of the drive shaft 36, facing outwardly from the central axis 64. The feed mechanism 40 may have the second binding element 138 positioned facing toward the opening 140, or binding elements placed in the bottom portion of the feed mechanism 40 (FIG. 50). The drive mechanism 26 will operate as previously with the magnetic clutch action described. Alternately, a portion of the drive shaft 26 can be formed from a magnet or magnetically attractable insert.

Figures 6A, 6B:
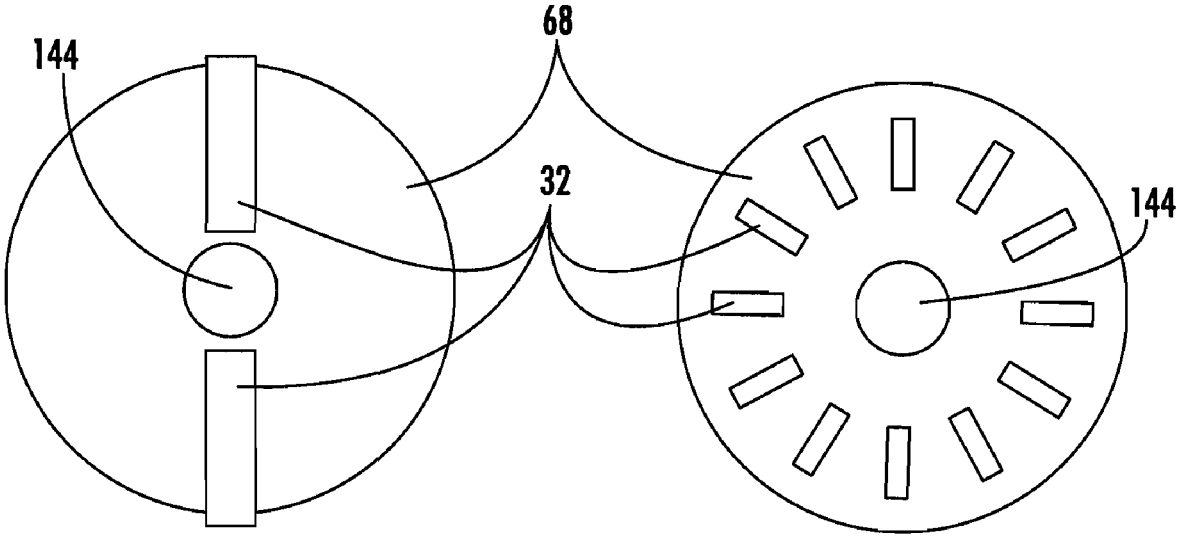
FIGS. 6A and 6B are top plan views of drive shafts of the present invention.
Figure 7:
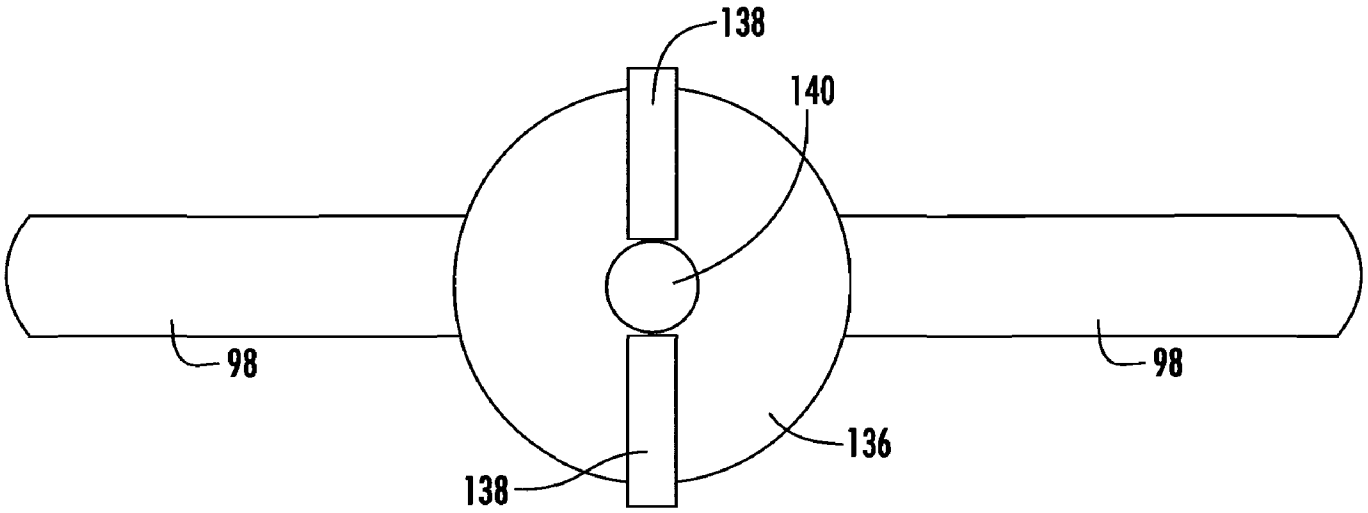
FIGS. 7 and 8 are bottom plan views of feed mechanisms of the present invention.
Figure 8:
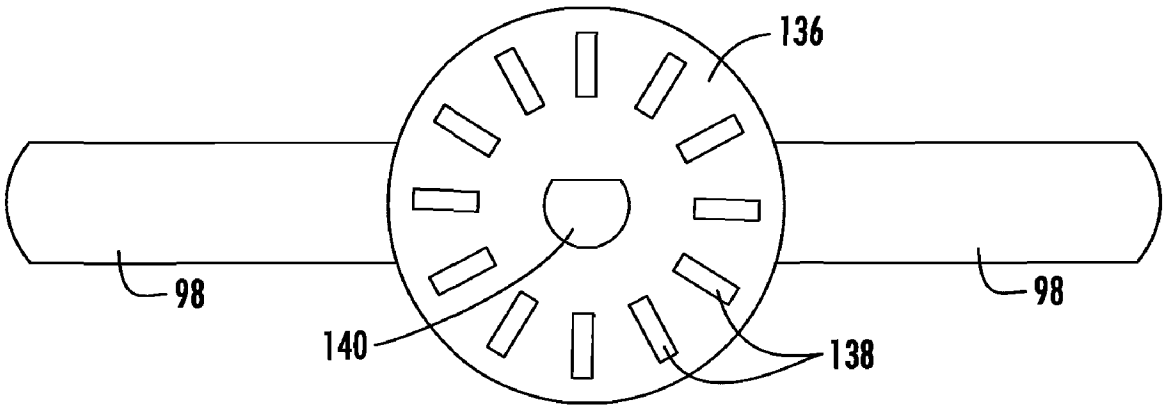

The second end 68 of the drive shaft 36 may include at last one or a plurality of binding elements 32, as shown in FIGS. 6A and 6B, top plan views of different embodiments of the drive shaft 26. Similarly, the feed mechanism 40 may include at last one or a plurality of binding elements 138, as shown in FIGS. 7-8. The operation of the drive mechanism 26 can be controlled by varying the number of binding elements, the strength of any magnets, and the distance between the binding element 32 and the second binding element 138, for example.

The motor 66 may be controlled by the controller 114 such as an electronic control circuit that may include a microprocessor 116. The paintball loader 10 may include at least one sensor 118 in communication with the motor 66 and/or controller 114 for detecting paintballs, such as an electromechanical sensor or switch, an optical sensor, and infrared (IR) sensor, a sound or shockwave sensor, or any other sensor as are known in the art. The controller 114 can control rotation of the motor 66 in either direction, providing for a reversible feed mechanism 40 operation.

Figure 9:
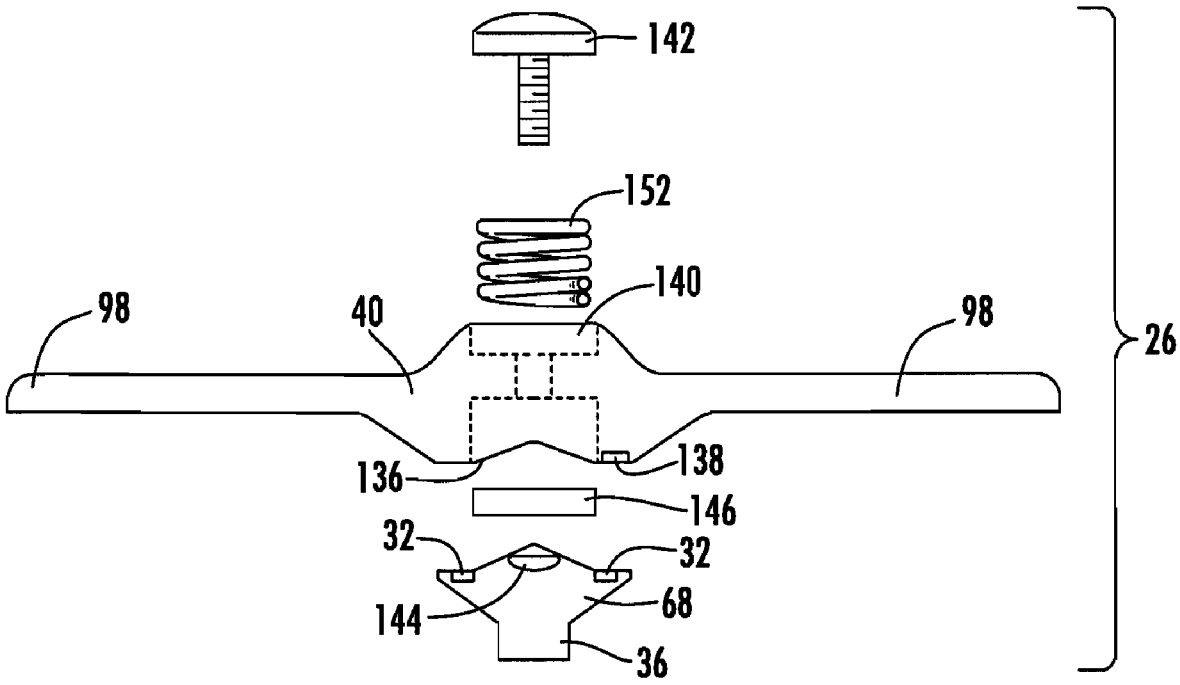
FIG. 9 is an exploded side elevational view of a fourth embodiment of a drive mechanism for a paintball loader according to the present invention.
Figure 10:
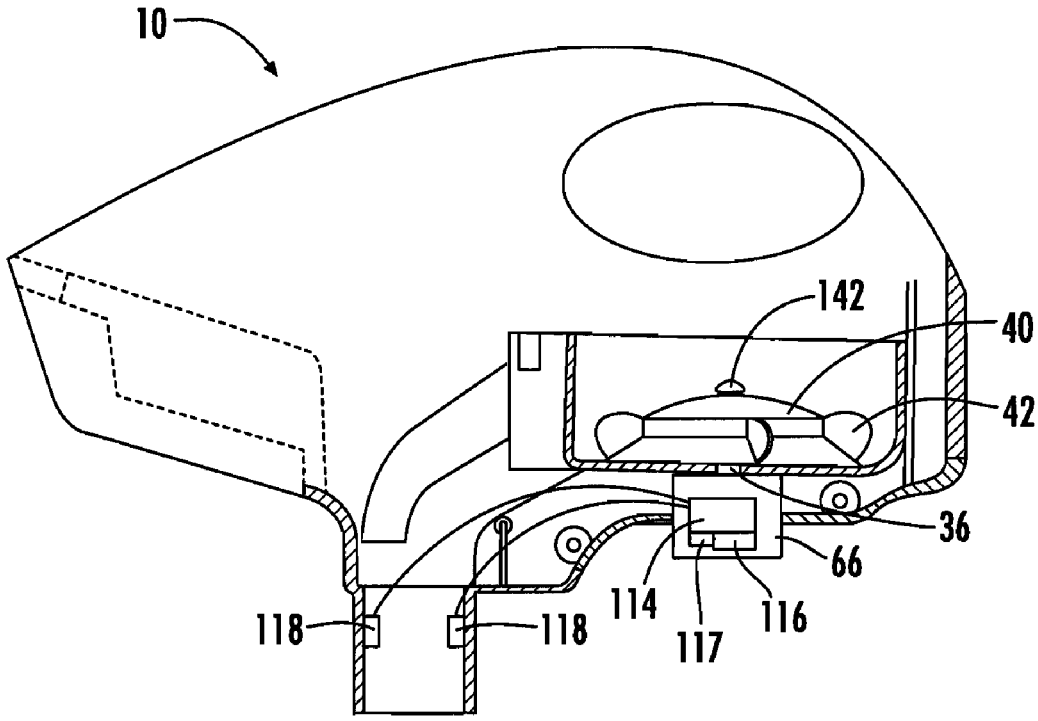
FIG. 10 is a side cross sectional view of a further embodiment of an illustrative paintball loader according to the present invention.
Figure 11:
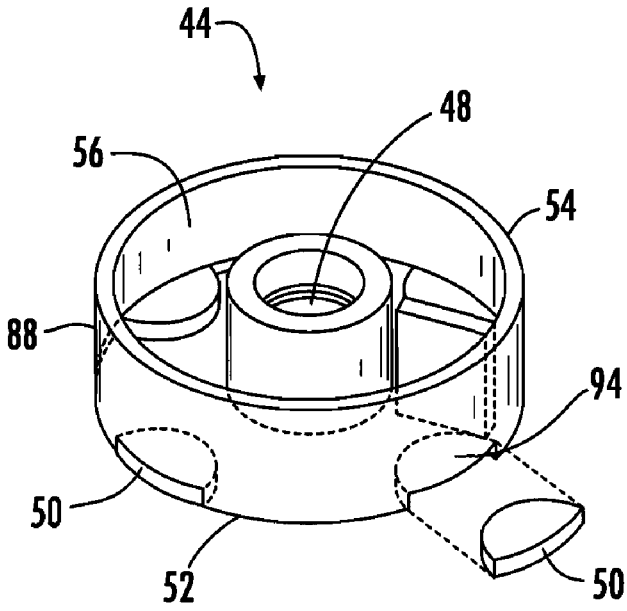
FIGS. 11-13, taken together, are an exploded isometric view of a still further embodiment of a drive mechanism for a paintball loader according to the present invention.

In an alternate embodiment, as shown in FIG. 9, the drive mechanism 26 includes a drive shaft 36 having an upper portion 68 that is contoured or angled. The lower portion 136 of the feed mechanism 40 is contoured complementary to the contour of the upper portion 68 of the drive shaft 36. A spring 152 is provided between the attachment screw 142 and the feed mechanism 40. At least one binding element 32 is positioned proximate the upper portion 68 of the drive shaft 36, and at least one second binding element 138 is positioned proximate the lower portion 136 of the feed mechanism 138, as previously described. In this arrangement, due to the complimentary contoured surfaces, the feed mechanism 40 is adapted for movement above and below its originally plane of movement if a projectile jam is encountered, in addition to the rotational movement of the feed mechanism 40 being driven by the drive shaft 36. The spring 152 biases the feed mechanism 40 back to its original position. An additional or alternate 146 spring can be provided between the upper portion 68 of the drive shaft 36 and the lower portion 136 of the feed mechanism 40.

Figure 13:
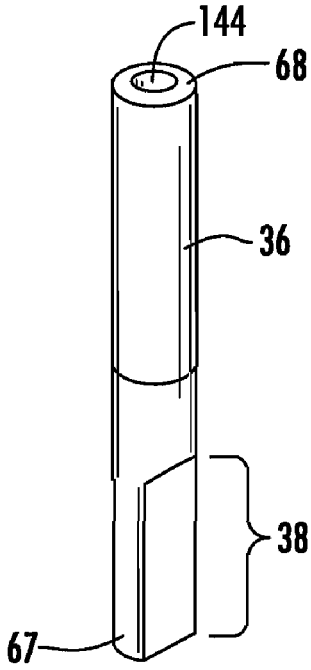
Figure 12:
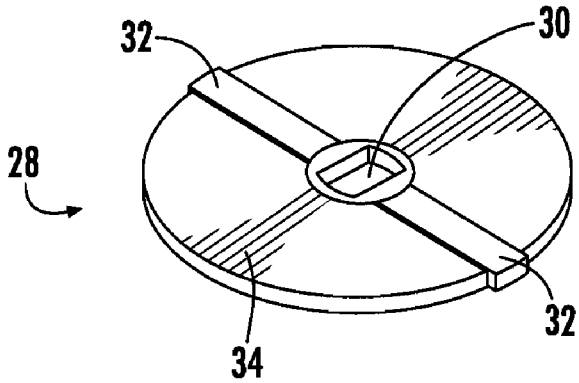
Figure 14:
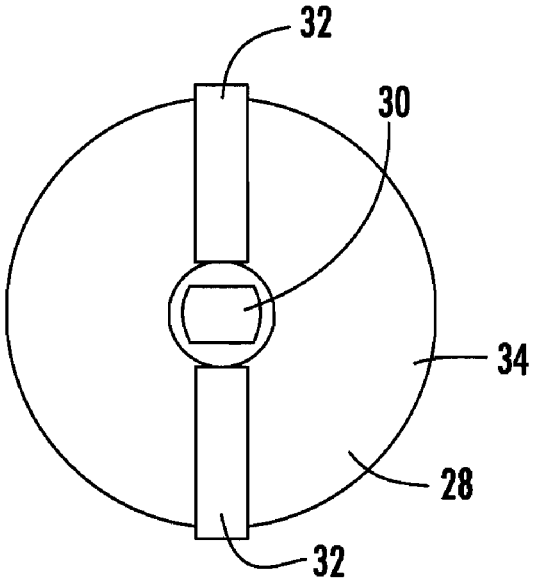
FIG. 14 is a top plan view of a clutch plate of a drive mechanism according to the present invention.
Figure 15:
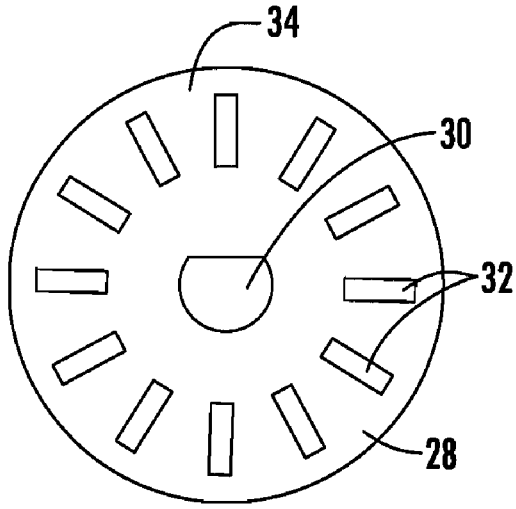
FIG. 15 is a top plan view of an alternate clutch plate of a drive mechanism according to the present invention.
Figure 16:
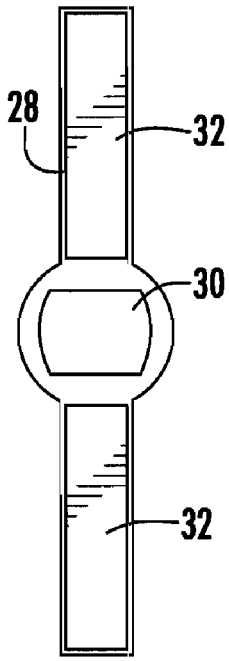
FIG. 16 is a top plan view of a further alternate clutch plate of a drive mechanism according to the present invention.

FIGS. 10-20 show an alternate embodiment of a drive mechanism according to the present invention for use in a paintball loader 10. According to this embodiment, drive mechanism includes a clutch plate 28, shown in detail in FIGS. 12 and 14-16, having a keyed opening 30 therethrough, and including at least one binding element 32. In the preferred embodiment, the binding element 32 is a magnet, but may also be a magnetically attractable insert. The clutch plate 28 may include one or a plurality of binding elements 32, as shown in FIGS. 14 and 15. The clutch plate 28 is preferably formed as a disc 34 with the keyed opening 30 shaped to accept a keyed portion 38 of a drive shaft 36, as shown in FIG. 13. The opening 30 may be any shape for accepting the drive shaft 36, as shown in FIGS. 14 and 15, so long as the keyed portion 38 of the drive shaft 36 can rotate the plate 28. The clutch plate 28 can be any size and/or shape suitable for its purposes as disclosed below, such as the alternate embodiment shown in FIG. 16, and may be comprised of any metal, plastic, or other suitable materials. Preferably, the clutch plate 28 is formed from a plastic, or other non-metallic, non-magnetic material. It should be understood that the clutch plate 28 can also be permanently affixed and part of the drive shaft 36.

Alternatively, the plate 28 may be formed entirely from the material comprising the binding element 32, such as a magnetic or magnetically attractable material. The plate 28 may also be formed with the binding elements 32 fashioned as rectangular inserts, as shown in FIGS. 12 and 14-16. The binding elements 32 may be removable, or permanently affixed to the plate 28. Through the variation of the binding elements, one is able to adjust the attractive forces to correspond with the specific properties of the projectile.

Figure 17:
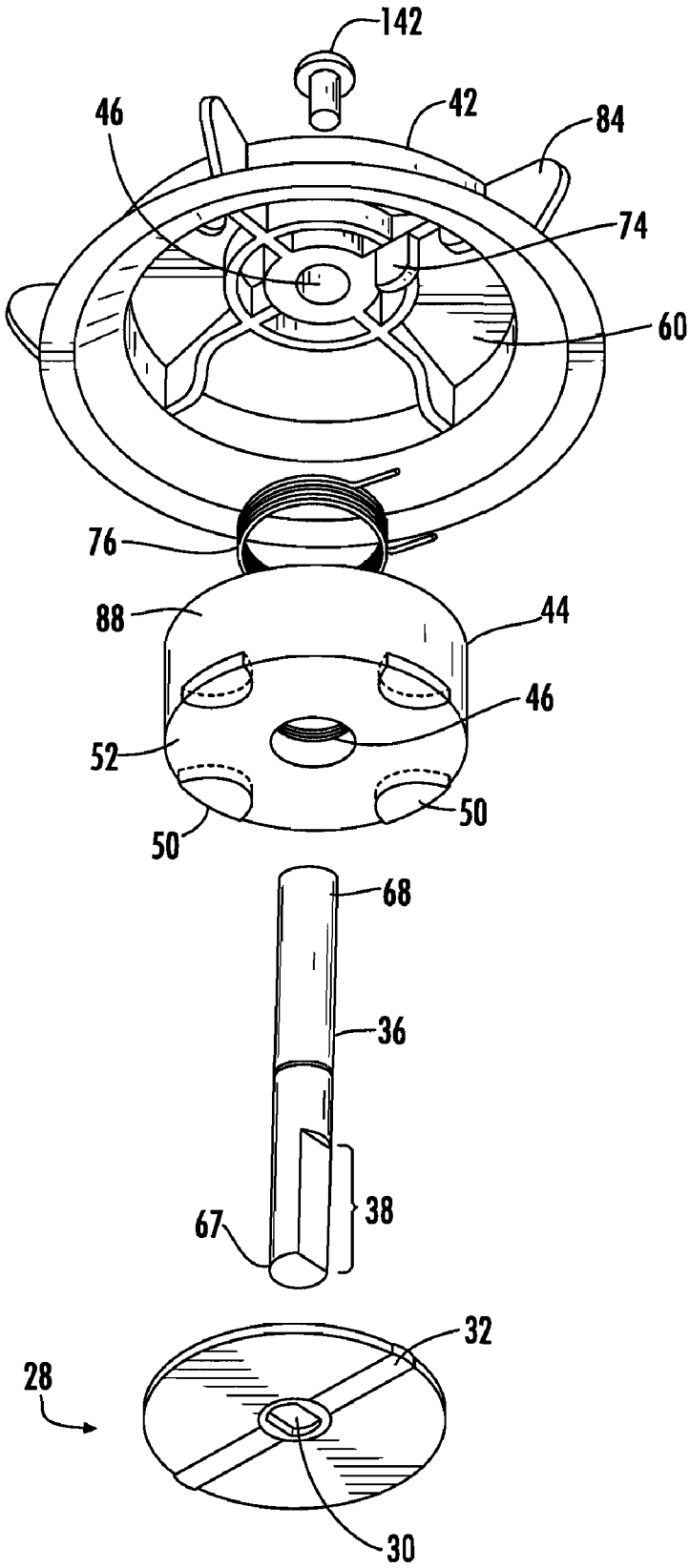
FIGS. 17 and 18 are exploded isometric views of a still further embodiment of a drive mechanism of a drive mechanism for a paintball loader according to the present invention.
Figure 18:
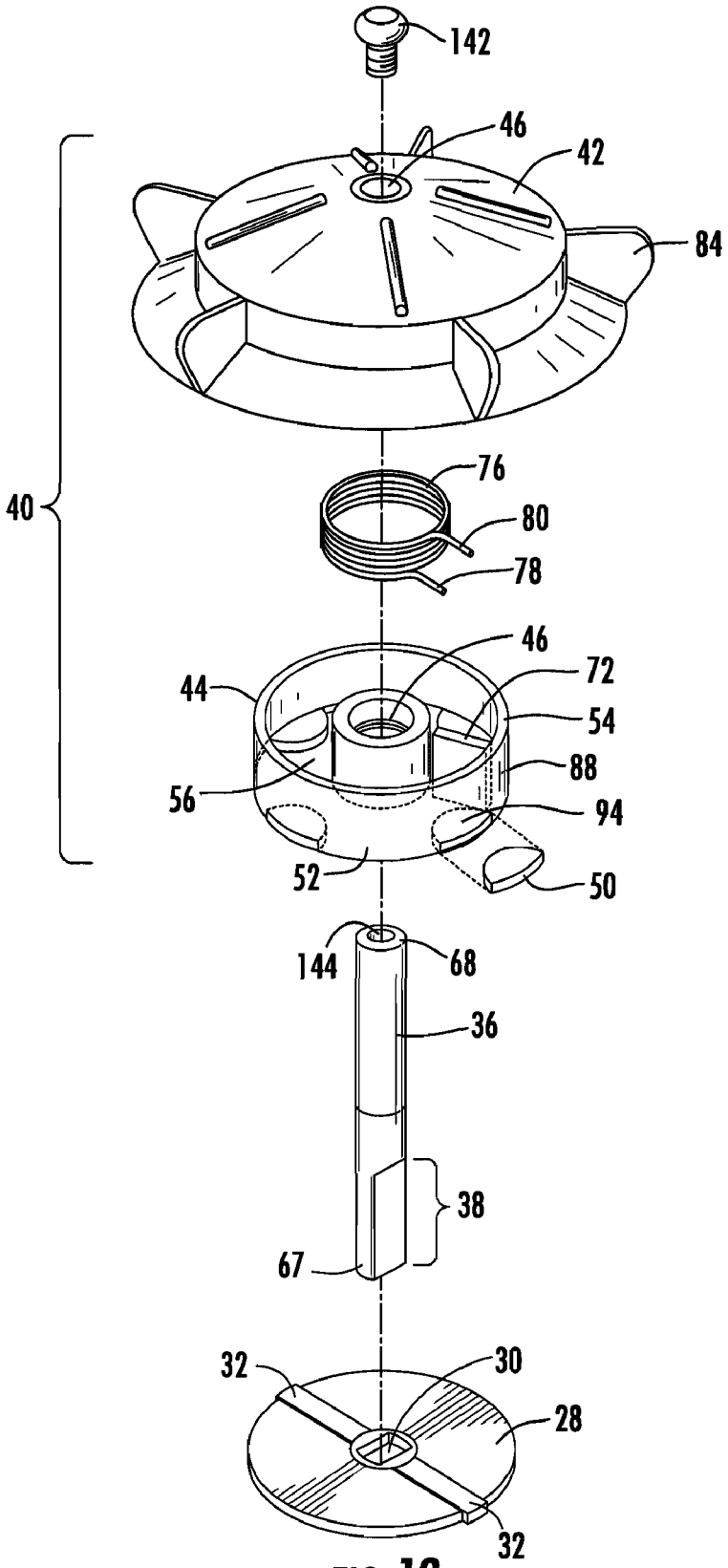
Figure 20:
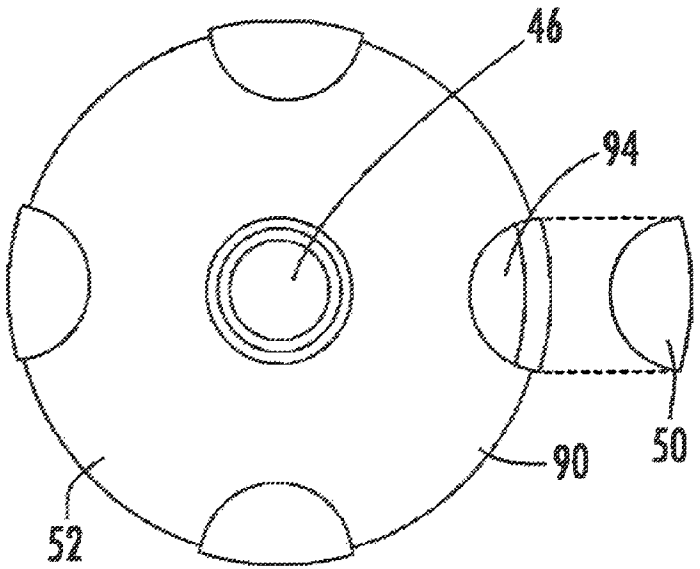
FIG. 20 is a bottom plan view of a base portion of the feed mechanism of the present invention.

FIGS. 13, 17, and 18 show a drive shaft 36 for providing movement to agitate, mix or move the projectiles 62 in the loader 10. The drive shaft 36 is adapted to rotate about its central axis under the force of a motor 66 to which it is coupled at its first end 67, preferably an electric, battery operated motor, although any motor is acceptable. The drive shaft 36 has an upper portion 68, which is preferably substantially circular and includes a threaded opening 144 for accepting a screw 142, and a lower keyed portion 38 shaped to engage the opening 30 of the clutch plate 28. Rotation of the drive shaft 36 by the motor 66 will in turn rotate the clutch plate 28, due to the engaging fit between the keyed portion 33 of the drive shaft 36 and the keyed opening 30. The drive shaft 36 may be constructed of various materials, such as molded plastic or metal, and is sized and shaped so that it is capable of passing through the opening 16 of the clutch plate 28 and the openings 22 of the paintball feed mechanism 40.

FIGS. 17-18 show a paintball feed mechanism 40 according to one embodiment of the present invention. The feed mechanism 40 shown may be similar in design and operation to the active feed assemblies disclosed in U.S. Pat. No. 6,792,933 and U.S. Pat. No. 6,701,907, the entire contents of which are incorporated fully by reference herein, which are used in connection with the well known HALO B® or EMPIRE™ RELOADER™ B paintball loaders. It is noted that the present invention may be used with, in place of, or as an adjunct to any other feed mechanism, agitator, paddle or impeller of any kind.

Figure 29:
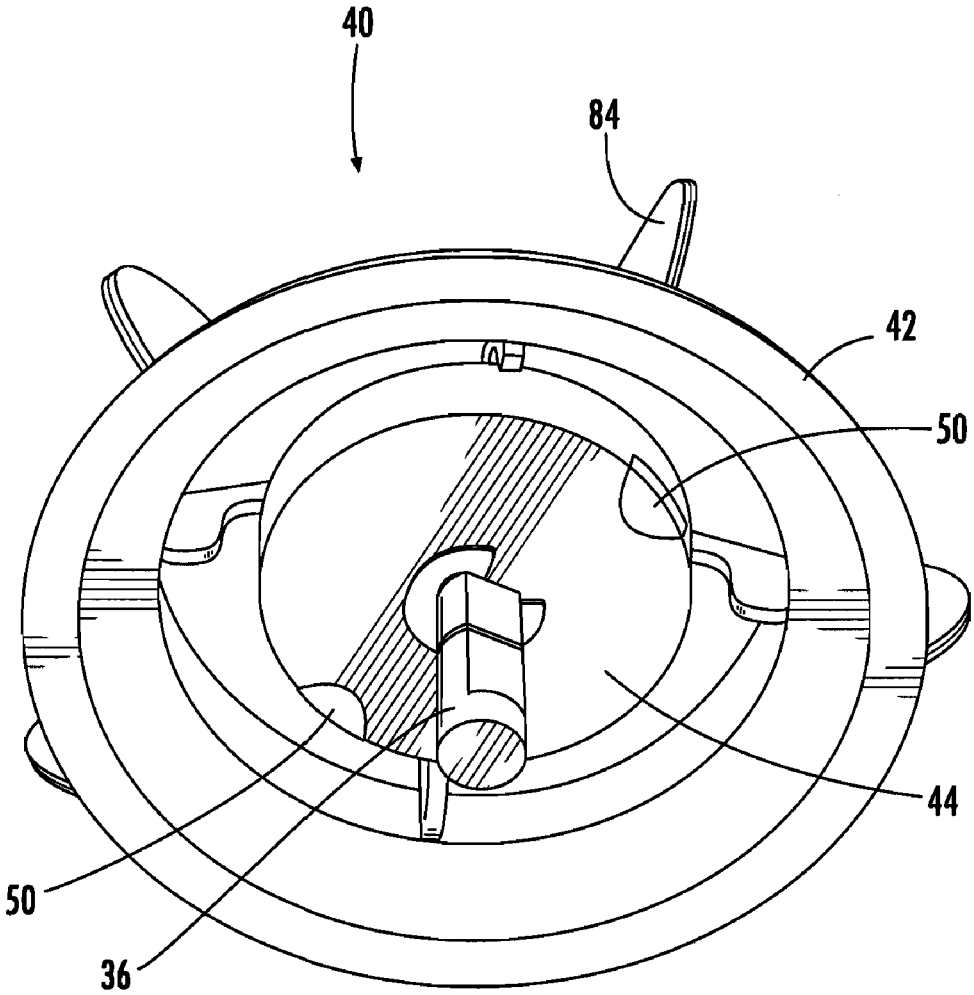
FIG. 29 is a bottom perspective view of an alternate feed mechanism.

According to this embodiment of the present invention, the feed mechanism 40 includes an impeller portion 42, and a base portion 44. The impeller portion has an opening 46 therethrough and the base portion 44 has an opening 48 therethrough. The openings 46, 48 are sized to accept a portion of the drive shaft 36, and to permit the feed mechanism 40 to freely rotate about the drive shaft 36. At least one binding element 50, preferably located on, formed in, inserted into, or affixed to the bottom surface 52 of the base portion 44. FIGS. 11 and 17-20 show the base portion 44 substantially the same size and shape as the clutch plate 28. The feed mechanism 40 may be larger or smaller than the clutch plate 28 or of a different shape. It is appreciated that the feed mechanism 40 can be provided as a single unit, with at least one binding element 50 positioned at any position to be attracted magnetically to the binding element 32 of the clutch plate 28, such as on a lower wall 82 including one or a plurality of binding elements 50, as shown in FIG. 29.

In a preferred embodiment, the base portion 44 of the feed mechanism 40 may be formed as an open cylinder having an upstanding annular wall 54 and a floor 58, as shown in FIGS. 11 and 17-19. The base portion 44 is positioned below the impeller portion 42. A gap or space 56 may be provided between the floor 58 of the base portion 44 and the lower face 60 of the impeller portion 42. In one embodiment of the present invention, the base portion 44 is formed as an open cylinder 88, having a base or floor 90 and an annular wall 92. The floor 90 may be provided with at least one or a plurality of cavities 94 sized and shaped to receive corresponding binding elements 50. The binding elements 50 can be sized and shaped to removably engaged the cavities 94 whereby the binding elements 50 will be sized to securely fit within the cavities 94 *a* shown in FIGS. 11 and 19-20, so that they will not fall out of the cavities 94 during operation. By being able to interchange the binding elements 50, magnetic attractive forces between the at least one magnetic portion of the drive shaft and the at least one magnetic or magnetically attractable portion of the feed mechanism can be varied and regulated. In this way the magnetic force is less than a rupture force of a paintball adapted to be loaded by the feed mechanism.

In the embodiment of the drive mechanism 26 of the present invention, shown in FIGS. 17-19 and 25-28, the feed mechanism has a spring-assist or spring-loaded component for feeding projectiles. A first spring contact wall 72 projects from the annular wall 54 of the base portion 44 into the gap 56. A second spring contact wall 74 projects from the lower face 60 of the impeller portion 42. A spring 76, preferably a torsion spring, is positioned within the gap 56, and has a first end 78 positioned adjacent the first spring contact wall 72, and a second end 80 positioned adjacent the second spring contact wall 74. It should be understood however, that any suitable biasing member can be used in place of the spring, for example, an elastomer. When the base portion 44 turns for example in the counter-clockwise direction (looking at the base portion 44 from above the loader 10), and the impeller portion 42 is stationary (due to being blocked by, for example, stationary projectiles in a "paintball stack" (line of stationary projectiles) in the loader 10), or the impeller portion 42 is moved in the clockwise direction (looking at the impeller portion 44 from above the loader 10), the spring 76 will be compressed due to the relative movements of the first end 78 of the spring 76 against the first spring contact wall 72, and the second end 80 of the spring 76 against the second spring contact wall 74. The spring 76 compresses, storing potential energy for driving projectiles. This provides a "spring-loaded" drive mechanism, where spring tension is provided for force feeding projectiles during operation when the feed impeller portion 42 is free to move.

Figure 19:
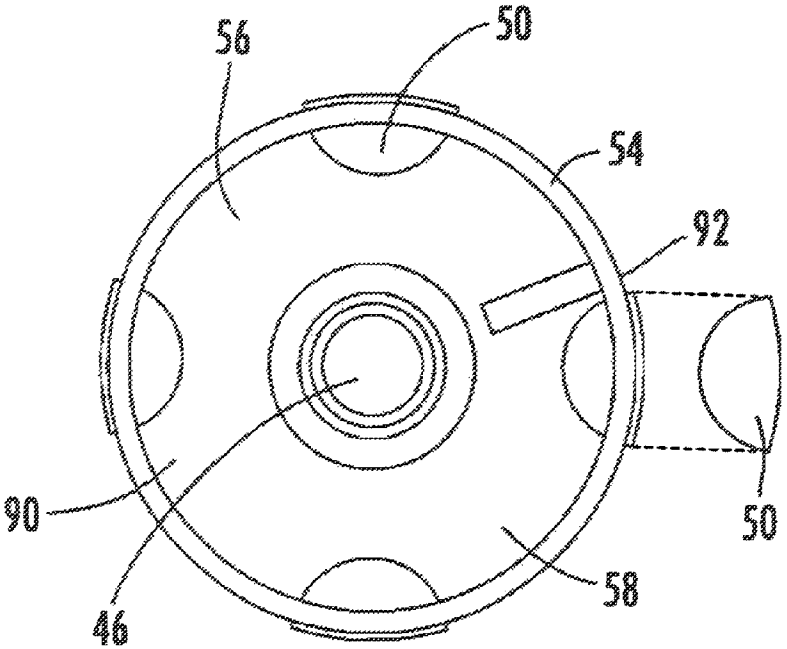
FIG. 19 is a top plan view of a base portion of the feed mechanism of the present invention.
Figure 21:
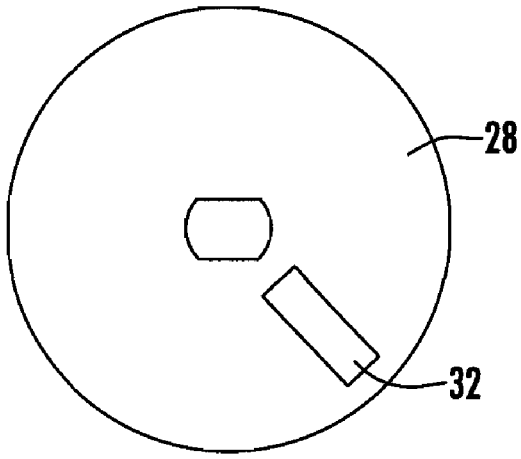
FIG. 21 is a bottom plan view of an alternate base portion of the feed mechanism of the present invention.
Figure 22:
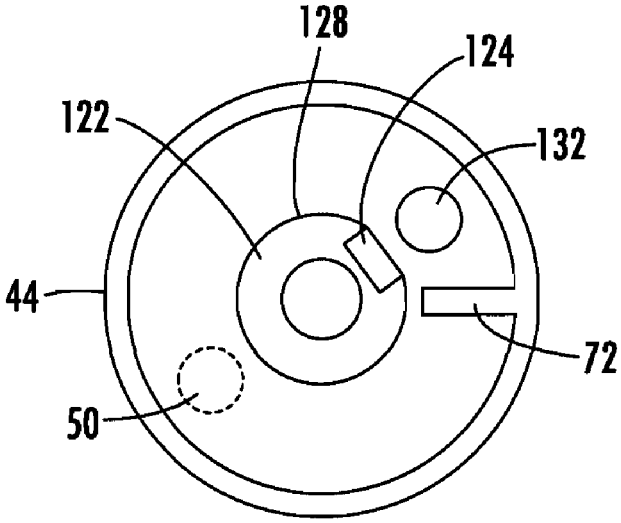
FIG. 22 is a top plan view of an alternate base portion of the feed mechanism of the present invention.

FIGS. 17-19 show an embodiment of the drive mechanism 26 of the present invention in an exploded view of the various components. The base portion 44 is positioned between the impeller portion 42 and the clutch plate 28. Where a spring is used, the spring 76 is positioned within the gap 56. The drive shaft 36 extends through the drive mechanism opening 30 and the respective openings 46, 48 of the base portion 44 and impeller portion 42. A screw 142 is threaded into the opening 144 of the drive shaft 36, and the screw 142 preferably has a head larger than the diameter of the opening 46, so that the feed mechanism 40 is held in place. The keyed portion 38 of the drive shaft 36 engages the keyed opening 30 of the clutch plate 28, such that rotation of the drive shaft 36 by the motor 66 produces rotation of the clutch plate 28. When the screw 142 is threadably engaged to the drive shaft 36, the screw 142 is effectively an extension of the drive shaft 36 running through the opening 46 in the feed mechanism 40. The feed mechanism 40 is free to rotate about the screw 142.

The binding element 32 of the clutch plate 28 is positioned to provide an attractive magnetic force when adjacent the binding element 50 of the base portion 44. It is appreciated that the binding element 32 and binding element 50 may be any combination of elements producing magnetic attraction between them, for example: binding element 32 is a magnet of a first polarity, and binding element 50 is a magnet of a second an opposite polarity; binding element 32 is a magnet, and binding element 50 is a magnetically attractable insert attractable to the magnet; and/or, binding element 32 is a magnetically attractable insert, and binding element 50 is a magnet.

The attractive magnetic force (also referred to herein as the "adhesion force") between the binding elements 32, 50 is preferably such that when the drive shaft 36 rotates and turns the clutch plate 28, the magnetic attraction between the binding element 32 and the binding element 50 correspondingly rotates the base portion 44 of the feed mechanism 40, which in turn rotates the impeller portion 42 of the feed mechanism 40. If a spring 76 is used, the rotation of the base portion 44 will be translated to the impeller portion 42 via movement of the first spring contact wall 72 against the end 78 of the spring 76, as described in greater detail above.

Figure 30:
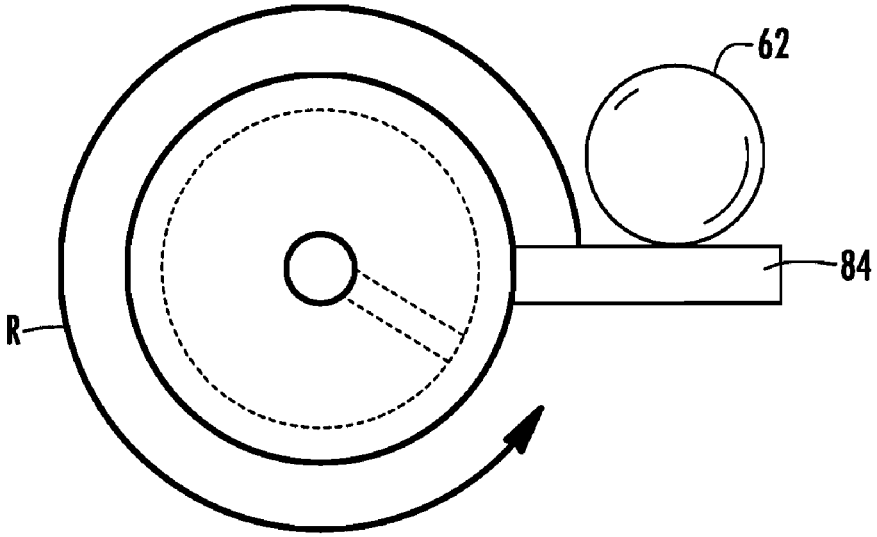
FIG. 30 is a top view of a feed mechanism of the present invention depicting rotation.

When the binding element 32 and the binding element 50 are aligned, the rotation of the clutch plate 28 drives the feed mechanism 40 by magnetic attraction between the binding elements 32, 50. During operation, the projection 84 of the impeller portion 42 may encounter a stationary or jammed projectile 62. In this instance, when the force of a stationary, jammed, or slow moving projectile 62 upon the feed mechanism 40 overcomes the magnetic force between the binding elements 32, 50, the motor 66 will continue to rotate the drive shaft 36, which will turn the clutch plate 28. The binding element 32 of the clutch plate 28 will "slip" or otherwise move past the binding element 50 on the base 44. The clutch plate 28 will continue to rotate independently of the feed mechanism 40. During each rotation of the clutch plate 28, the binding element 32 will be magnetically attracted to the binding element 50 of the base 44 when the binding elements 32, 50 are in proximity such that they are magnetically attracted. When the feed mechanism 40 is free to again rotate (such as when the paintball stack is moving, or a jammed projectile 62 is dislodged) the binding element 32 will again attract the binding element 50, and the feed mechanism 40 will rotate to propel or otherwise mix projectiles 62.

Where a spring 76 is used as discussed in detail above, the binding elements 32, 50 should be selected such that the magnetic force (adhesion force) between the binding elements 32, 50 is strong enough to overcome the biasing force of the spring 76 on the walls 72, 74, yet will "slip" when the spring 76 is compressed or otherwise wound to a certain selected degree or amount. A paintball stack may form, for example, when a paintball marker to which a paintball loader is attached has indexed projectiles 62 in the outfeed tube and feed neck 22, but the paintball marker 12 is not being fired. Projectiles 62 back up forming a stack. When the projection 84 contacts the stationary paintball stack, the base portion 44 will continue to turn, by way of example, counter-clockwise, if the feeding direction is counter-clockwise. This will compress and increase tension in the spring 76 as the base portion 44 rotates relative to the impeller portion 42. However, it may be desired that the drive mechanism will slip (the adhesion force between the binding elements 32, 50 is overcome) when the spring 76 is compressed to a certain degree or amount, which may be a user selected degree or amount. For example, the binding elements 32, 50 may be selected such that, when the base portion 44 rotates a certain angular distance relative to the point of contact between the projection 84 and the paintball stack, the binding elements 32, 50 slip. This is shown schematically in FIG. 30, which is a schematic bottom view of a projection 84 contacting a paintball stack. The angular distance can be selected by a user, and can be any angular distance, with a preferred distance being approximately about 340 to 360 degrees of rotation.

Released from the forces of the attraction between the binding elements 32, 50, the base portion 44 will unwind (in a clockwise direction in the example) as the spring 76 releases tension. A second binding element 32 may be positioned on the clutch plate 28, to "catch" or attract the base portion 44 as it unwinds, so that the spring 76 does not fully decompress. In this manner, tension is retained in the spring 76 for propelling projectiles 62 once the stack begins to move. In addition, the slipping action of the drive mechanism will not force, break or otherwise crush or rupture projectiles. A plurality of binding elements 32 maybe provided on a clutch plate 28. Each of the binding elements 32 will attract the binding element 50, as the clutch plate 28 rotates.

The operation of the novel drive mechanism of the prevent invention can be adjusted in several ways. For example, the force necessary to overcome the magnetic attraction between the binding elements 32 and 50 can be adjusted by utilizing magnets of varying magnetic strengths. The size of the magnets used for the binding elements 32, 50 can be varied. The distance between the clutch plate 28 and the bottom surface 52 of the feed mechanism 40 can also be varied, thus adjusting the interaction of the magnets and/or magnet and magnetically attractable inserts. A shim or other divider piece can be formed between the clutch plate 28 and the bottom surface 52 of the feed mechanism 40. In addition, the spring 76 can further be selected having a particular tension.

Figure 5:
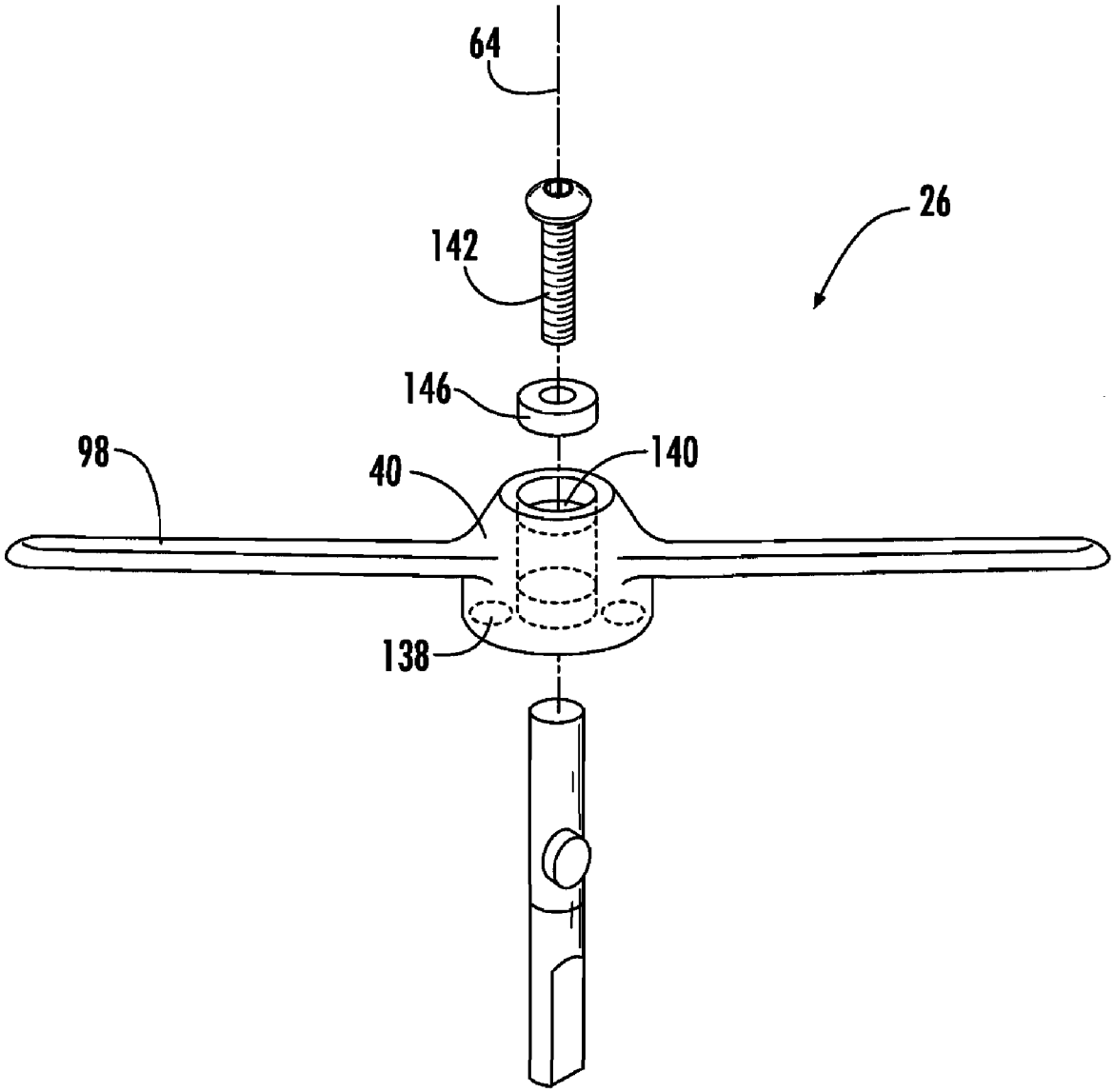
FIG. 5 is an exploded isometric view of a third embodiment of a drive mechanism for a paintball loader according to the present invention.

The number of binding elements 32, 50 can be varied, such as illustrated in FIGS. 14-15 and 17-18. A user of a paintball loader according to the present invention can adjust the operation by selectively inserting and positioning binding elements 50 within the cavities 94. Alternately, a cylinder 88 can be provided with a preselected number of binding elements 50, attached or affixed to, formed in, or formed on the floor 90 of the cylinder 88. Several cylinders 88 may be included with a paintball loader kit, incorporating different numbers of binding elements 32 that may be user selected, based on operating conditions such as paintball shell brittleness. Similarly, as shown in FIGS. 5-7, the clutch plate 28 may be formed including at least one or a plurality of binding elements 32. The binding elements 32 can be preformed on or affixed to the clutch plate 28, or may be held within cavities formed in the clutch plate 28. Several drive mechanism bases 28 having different binding element 32 configurations may be provided in a kit with a paintball loader according to the present invention.

It should be appreciated that the drive system 34 operates as a clutch system to avoid or manage projectile jams, and to provide fine-tuning of paintball loader operation. If the feed mechanism 40 stops or slows its rotation relative to the rotation of the drive mechanism 26 and drive shaft 36 due to a jam, the system will not chop or otherwise break projectiles. Projectiles may back-up or otherwise block the outlet tube, and interfere with the rotation of the projections 84, which slows or stops the feeder 36. In the many loaders currently known in the art the feeder 36 continues to try to rotate with the force of the motor, and therefore, the projections 84 continue to try to impel projectiles through the loader. The continued impelling force from the feeder on the jammed projectiles can break the projectiles, the feeder 36, the impellers 39, and/or other parts of the loader.

In the present invention, when the feed mechanism 40 stops rotating, the force of the rotation of the drive shaft 36 on the clutch plate 28 overcomes the magnetic attraction between the binding elements 32, 50. This causes the feed mechanism 40 to move relative to, or slip past the base portion 44. The drive mechanism 26 no longer rotates the feed mechanism 40, which therefore, no longer rotates the feeder 36. Thus, the feeder impellers 39 stop moving against the stationary, jammed or blocked projectiles.

When the paintball jam is cleared (players often shake or jostle the hopper), and the feeder 36 and paintball feed mechanism 40 are free to once again rotate, the drive mechanism 26 binding element 32 will attract the paintball feed mechanism 40 binding element 50 and begin rotating the paintball feed mechanism 40 and the connected feeder 36 in conjunction therewith.

In another embodiment of the present invention, an entire surface of the clutch plate 28 may be formed as a binding element, such as a magnet or a magnetically attractable material. In addition, in another embodiment, an entire surface of the floor 58 of the base portion 44 may be formed as a binding element, such as a magnet or a magnetically attractable material.

Figure 23:
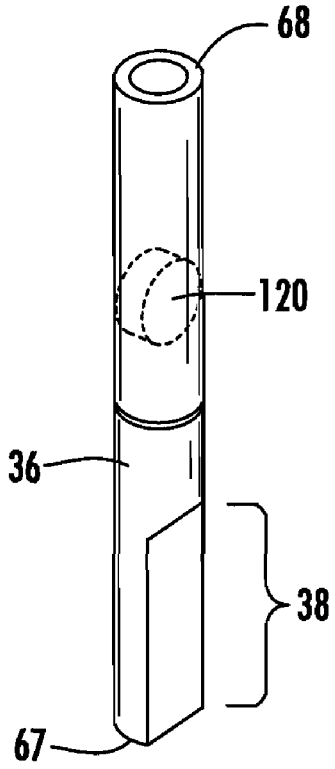
FIG. 23 is an isometric view of an alternative drive shaft of a drive mechanism for a paintball loader of the present invention.
Figure 24:
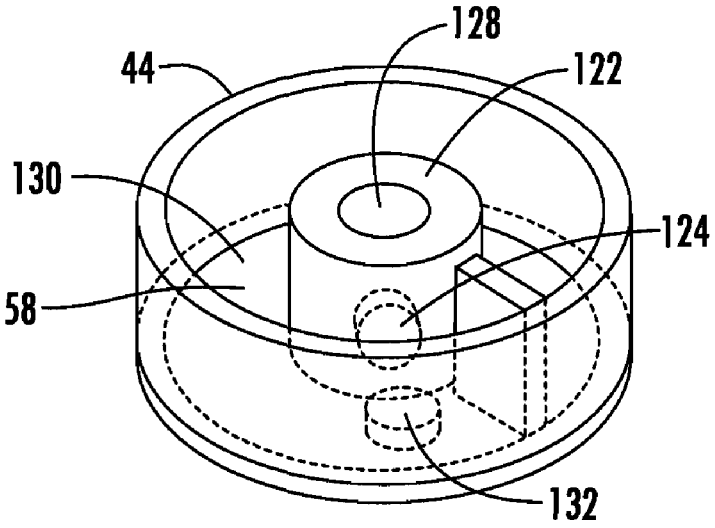
FIG. 24 is an isometric view of a base portion corresponding to the shaft of FIG. 23.
Figure 25:
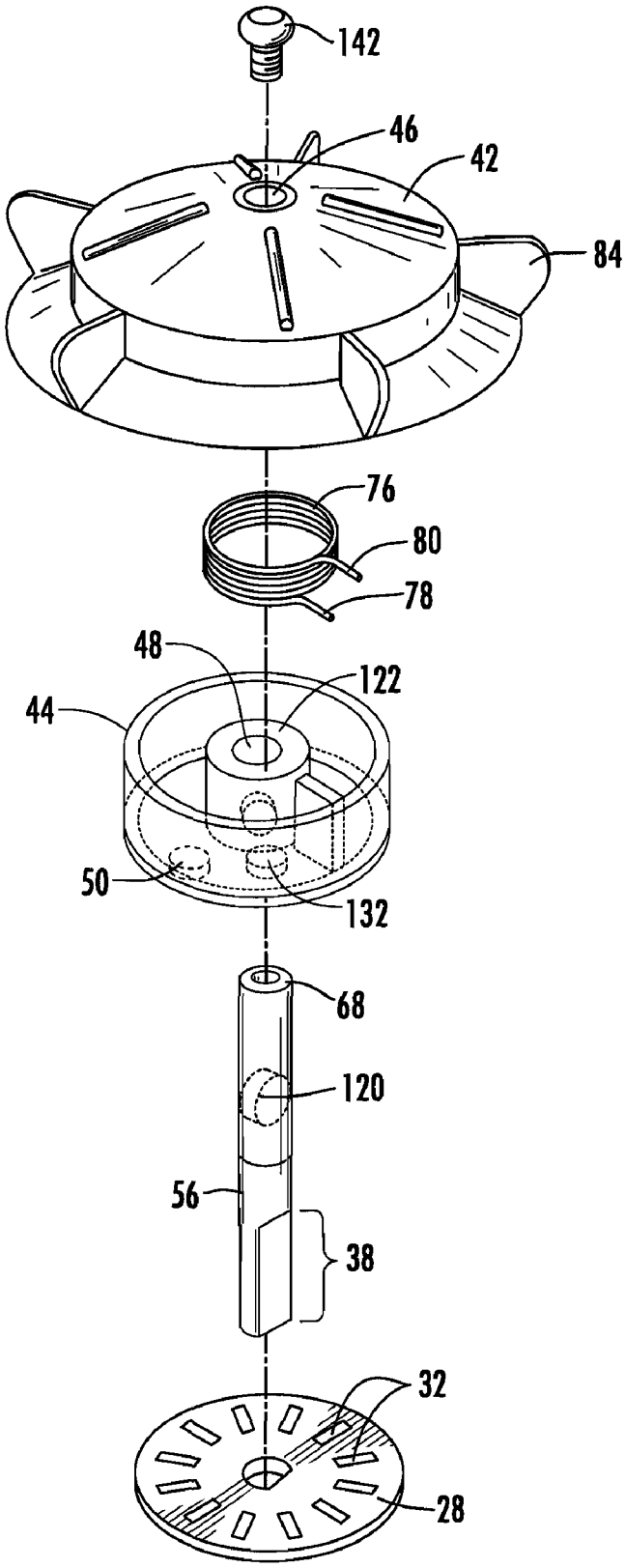
FIGS. 25 and 26 are exploded isometric views of a still further embodiment of a drive mechanism according to the present invention.
Figure 26:
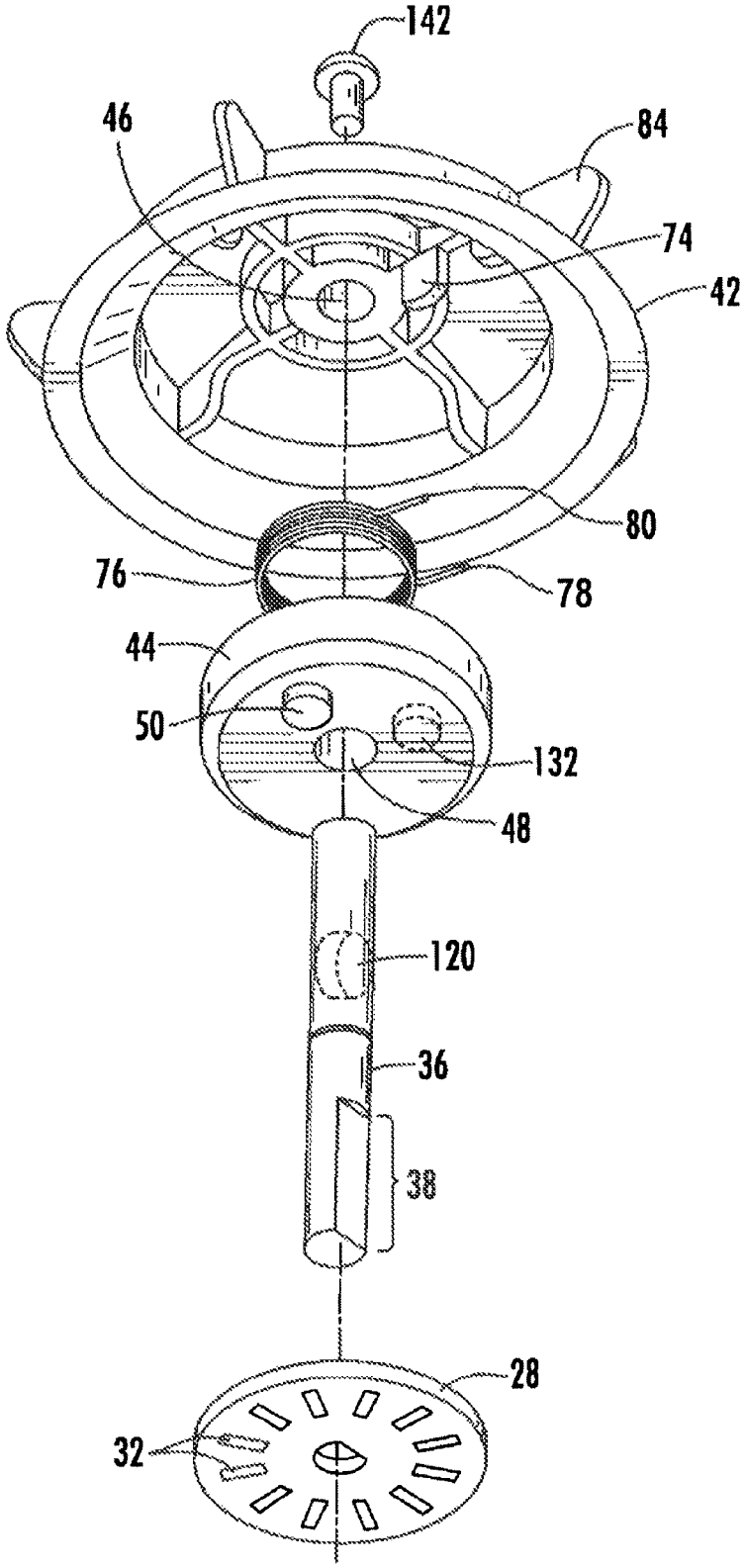

In another embodiment of the present invention, shown in FIGS. 21-26, the drive shaft 36 may be formed to act as an additional slip clutch mechanism. Such an embodiment may be used in addition to the previously disclosed embodiments, or may replace the clutch plate 28 and base portion 44 as previously described. At least one binding element 120, which may be a magnet or magnetically attractable insert, is provided on or within the drive shaft 36, as shown in FIG. 23.

A central portion 122 of the base portion 44 is adapted to rotate independently from the other portions of the base portion 44. The central portion 122 includes at least one binding element 124, which may be a magnet or magnetically attractable insert, positioned adjacent an annular wall 128 of the central portion 122. Binding element 120 and binding element 124 are selected so that they are magnetically attracted to each other.

The upper surface 130 of the floor 58 of the base portion further includes at least one binding element 132, which may be a magnet or magnetically attractable insert. Binding element 132 is selected so that it is magnetically attracted to binding element 124.

In the embodiments shown in FIGS. 21-26, a second slip clutch mechanism is disclosed. The binding element 120 of the drive shaft 36 will rotate when the drive shaft 36 is rotated by the motor 66. Binding element 120 will magnetically attract binding element 124, thus rotating the central portion 122 through magnetic attraction. The binding element 124 will in turn attract binding element 132, thus turning, or assisting in turning, the balance of the base portion 44. These additional binding elements 120, 124, 132 can be use as adjuncts to the previously described binding elements 32, 50. Thus, binding element 32 will magnetically drive binding element 50, acting as a first magnetic slip clutch system, and binding element 120 will magnetically drive binding element 124, which in turn will magnetically drive binding element 132, acting as a second magnetic slip clutch system. Any combination and positioning of the various binding elements may be used to achieve desired operation of the drive mechanism 26 of the present invention.

Figure 27:
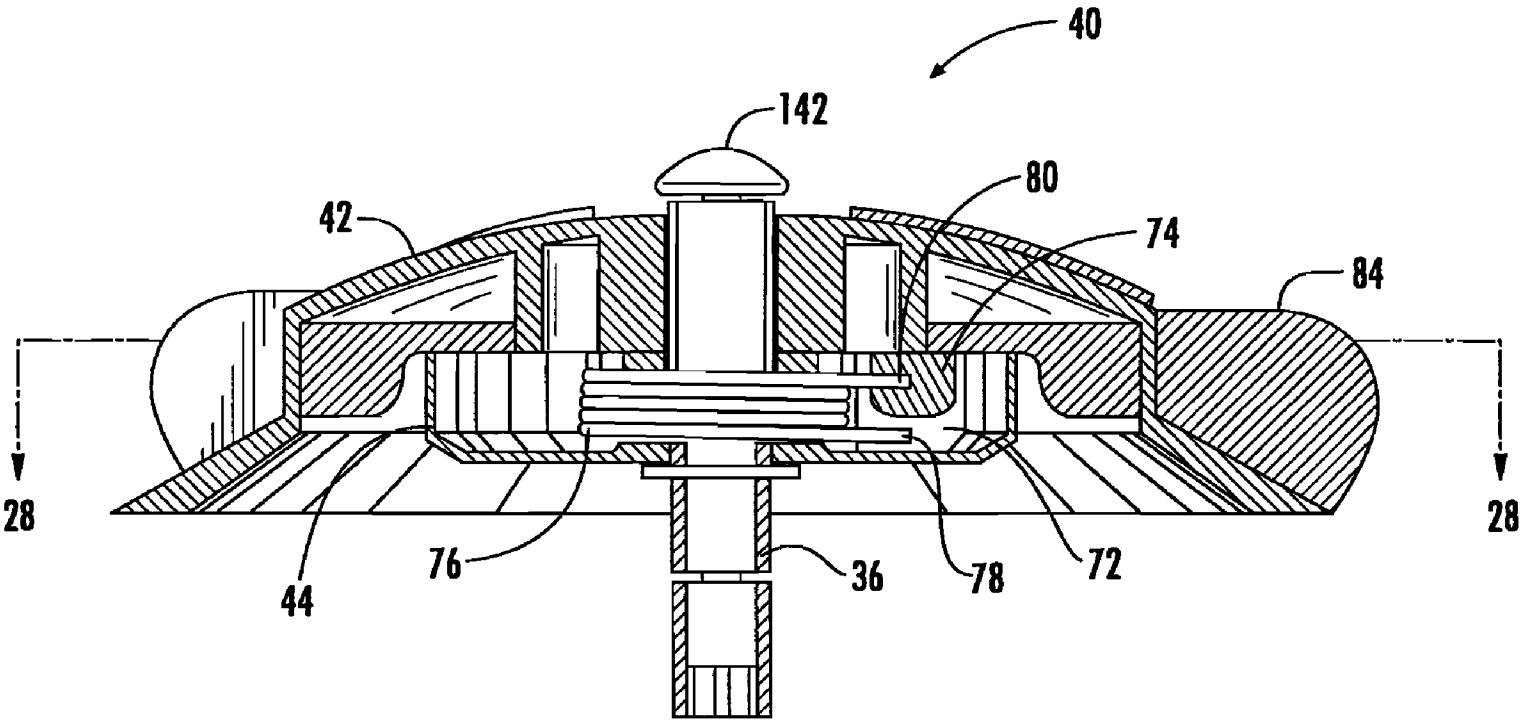
FIG. 27 is a side sectional view of the feed mechanism shown in FIGS. 25 and 26.
Figure 28:
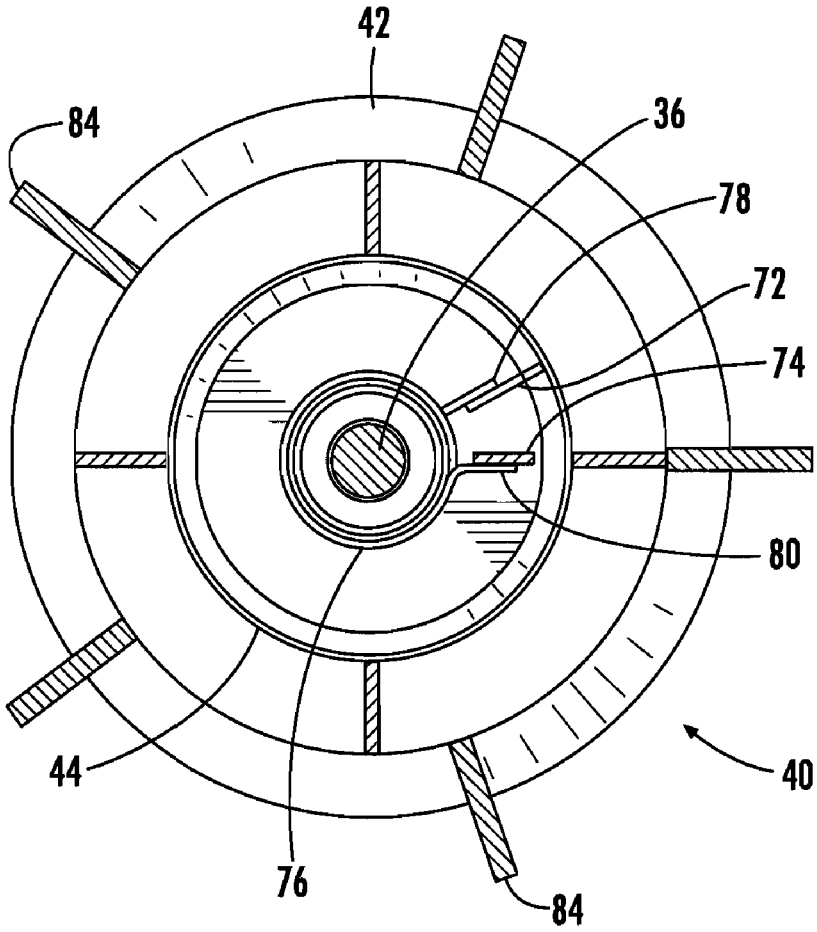
FIG. 28 is a sectional view taken along line 28-28 in FIG. 27.

A cross section of the feed portion 40 of the feed device 26 is shown in FIGS. 27 and 28. The base portion 44 houses the spring 76 having first and second ends 78, 80 that are biased against a first contact wall 72 of the base portion and a second contact wall 74 of the impeller portion 42, respectively. It should be understood that other biasing members can also be used, for example, an elastomer. When sufficient tension is present in spring 76, the impeller portion 42 is rotated such that impeller projections 84 contact a projectile 62 to urge it into a feed tube 112 of a loader 10 and into a breech of a gun 12.

In addition, in an alternate embodiment, the clutch plate 28 can be eliminated, and the drive shaft 36 will act as the clutch system for the drive mechanism 26. Further, the central portion 122 can be eliminated, and the binding element 120 of the drive shaft 36 can be selected to directly magnetically attract the binding element 132 of the upper surface of the floor 130.

Figure 31:
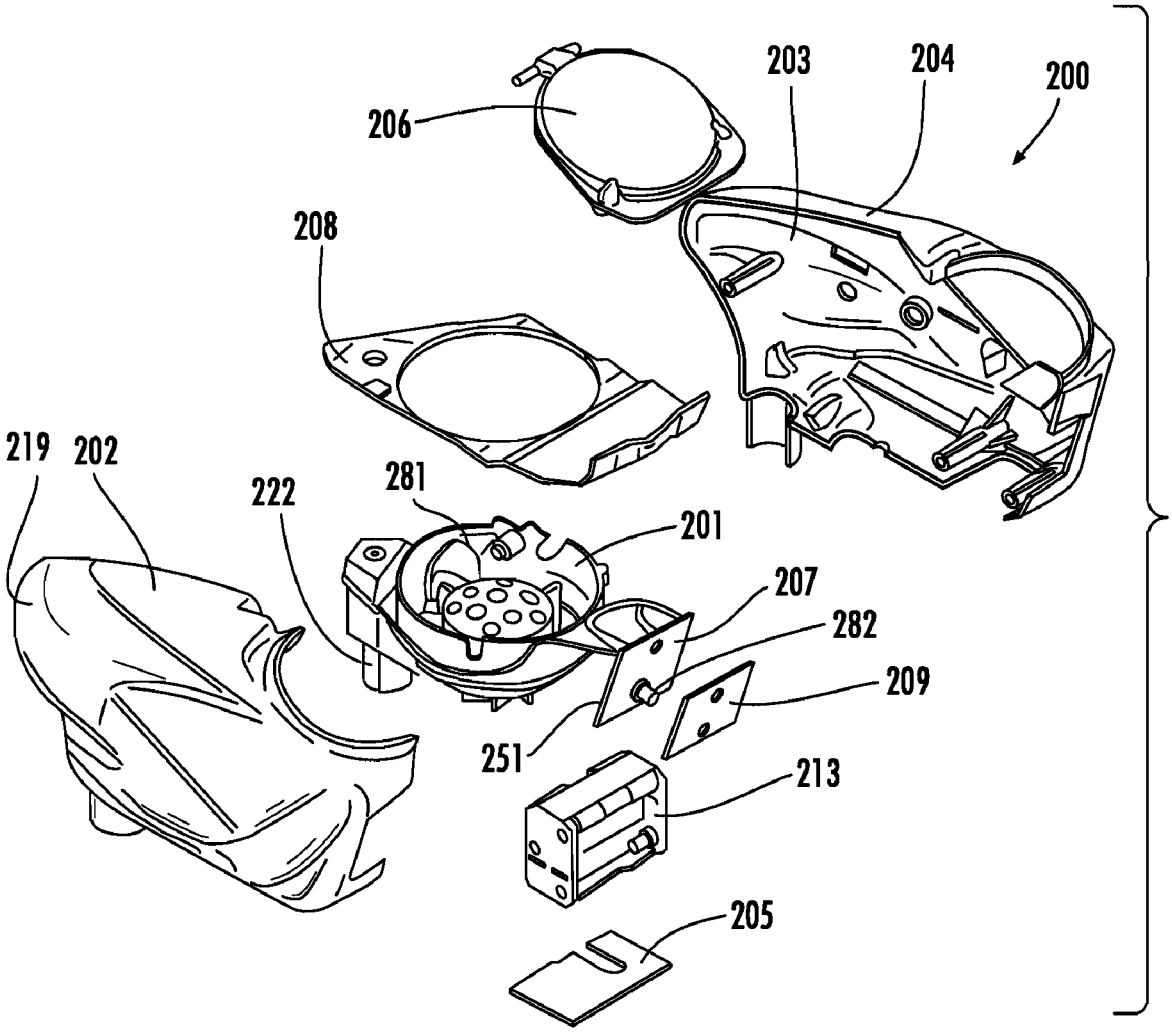
FIG. 31 is an exploded view of loader utilizing the feed mechanism of the present invention.

FIG. 31 is an exploded view of another embodiment of an exemplary paintball loader 200 of the present invention. The loader 200 includes a body 219 which may include left and right shell portions 202, 204 which, when joined, create an interior paintball chamber 203 for the storage of paintballs. The loader 200 includes a pivotally attached lid 206 which provides an opening through which paintballs are added to the interior chamber 203 of the loader 200 for feeding to a paintball marker. A floor insert 208 provides a bottom surface for the interior paintball chamber 203 and includes an opening through which paintballs move from the interior paintball chamber 203 into a cup assembly 201. In a preferred embodiment, the contours of the interior surfaces of the shells 202, 204 may be formed to securingly mate with the cup assembly 201, although it is appreciated that the cup assembly can be attached to interior of the loader 200 through any suitable means.

Figure 32:
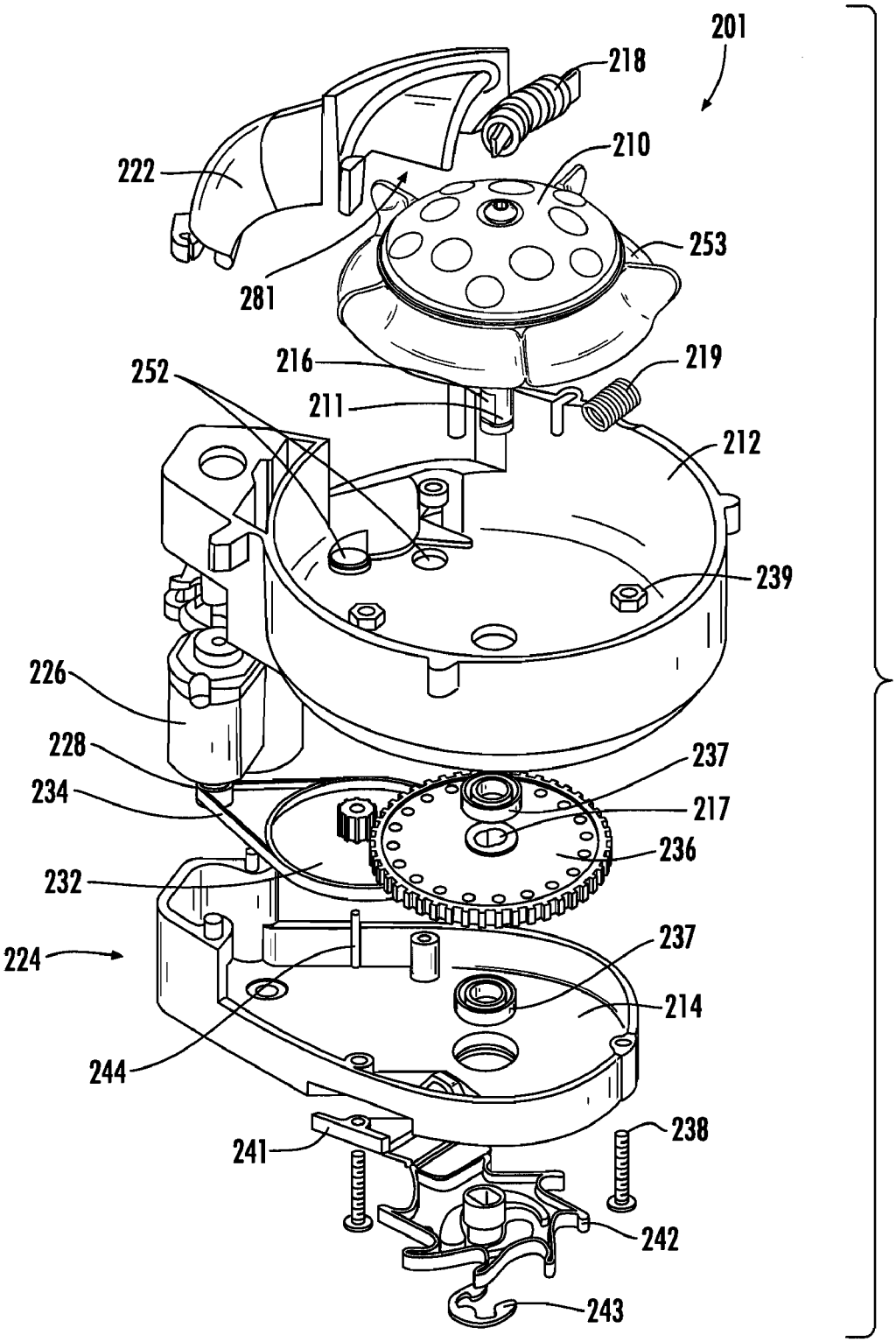
FIG. 32 is an exploded view of the drive assembly of the feed mechanism of the present invention.

As shown in detail in FIG. 32, the cup assembly 201 features a catch cup 212 positioned below the opening in the floor piece 208 that accepts paintballs from the interior paintball chamber 203 of the loader 200. A feed mechanism 210 is placed into the catch cup 212, with its shaft 211 inserted through the cup 212. In use, the feed mechanism 210 is designed to feed projectiles from the catch cup 212 into the exit portion 281 of the outfeed tube 222.

A motor 226 is provided to drive the feed mechanism 210 and may drive the feed mechanism via drive system including a gear, gears or gearbox 224. The motor 226 is preferably mounted adjacent the catch cup 212 as shown in FIG. 32 and preferably comprises a DC motor, although any suitable motor or driving mechanism (such as a stepping motor) may be utilized without departing from the scope of the present invention. The motor 226 may be controlled by a controller or circuit board 207 (FIG. 31), such as electronic control circuitry that may include a microprocessor 251. The paintball loader 200 may also include at least one sensor 252 in electrical or wireless communication with a motor 226 and/or controller 207 for detecting paintballs (such as by movement or position, for example) and/or movement or position of the feed mechanism 210. The sensor 252 may be an electromechanical sensor, a switch, an optical sensor, a break beam sensor, and infrared (IR) sensor, a reflective sensor, a sound or shockwave sensor, a piezoelectric sensor, or any other sensor as are known in the art for detecting paintball movement or feeder movement. The controller 207 can control rotation of the motor 226 in any direction, providing for a reversal of the rotation of the feed mechanism 210 enhancing its ability to clear projectile jams. In operation, the user may actuate the controller 207 via a switch plate 209 locate on the exterior if the loader 200, such as by pressing a button 282 on the switch plate 209. In one embodiment, at least one power source such as a battery 213 is provided to power the motor and/or additional controls or sensors. The battery 213 is preferably stored inside of the loader 200, and features a cover 205 to facilitate easy removal and replacement.

In one embodiment, the gearbox 224 comprises a belt and pulley system having a first pulley 228, a drive belt 234, and a second pulley 232. The second pulley 232 comprises an integral pinion gear 233 configured to drive a spur gear 236. The shaft 211 of the feed mechanism 210 is preferably keyed into the spur gear 236 by means of a profiled portion 216 of the shaft 211 and complementary profiled opening 217 of the spur gear 236, whereby the rotation of the spur gear 236 rotates the feed mechanism 210.

It is envisioned that this combination belt drive and gear arrangement could be replaced with any other suitable means to transmit the rotational force of the motor 226 to the feed mechanism 210 including direct, gear, belt, or fluid drives. It is also envisioned that the size of respective pulleys 228, 232 and gears 233, 236 could be varied in order to change the rotational speed of the feed mechanism 210, thereby varying the feed rate of the balls into the marker, as well as the torque delivered by the shaft 211. A motor 226 may also directly drive the shaft 211 of the feed mechanism 210, without the use of additional gears or belts. Any arrangement for coupling the motor to the drive shaft to operate the drive shaft is contemplated as included within the scope of the present invention.

The shaft 211 of the feed mechanism 210 may be supported on either side of the spur gear 236 by bushings or bearings 237. In a preferred embodiment, one bearing 237 is positioned in or between each of the catch cup 212 and a gearbox cover 214, and the spur gear 236.

The gearbox cover 214 preferably provides a generally sealed enclosure for the gear box assembly 224 and motor 226, protecting the components from dirt, debris, and other objects which could potential jam the mechanism and/or inhibit its function. A cover 241 may be utilized to provide access to the gearbox assembly 224 to facilitate maintenance, inspection, or any other suitable use.

The gearbox cover 214 is preferably secured to the bottom of the catch cup 212 by fasteners 238. In one embodiment, the fasteners 238 comprise standard bolt and nut 239 combinations, however it is envisioned that other suitable attachment means may be utilized. In a more preferred embodiment, dowel pins 244 may be used in combination with the fasteners 238 to ensure the proper orientation of the gear box cover 214 with the catch cup 212.

An anti-jamming or manual winding wheel 242 is preferably provided on an end of the shaft 211 accessible outside of the loader 200 in order to provide a means to manually rotate the feed mechanism 210, thereby facilitating the clearing of any jams in the system, or otherwise rotating the drive shaft based on a user's needs. Such an anti-jamming and/or manual reversing mechanism is disclosed in U.S. Pat. No. 7,343,909, the entire contents of which is incorporated by reference herein. The wheel 242 is preferably keyed to the shaft 211 at a lower portion 216 and is secured by use of a retaining clip 243, however, any suitable means of connection may be used.

Additional means to prevent jamming include resiliently mounted beads 218 and/or an anti-jamming deflection spring 219 mounted to the interior of the loader 200, adjacent the outfeed tube 222. In one embodiment, these elements are mounted to an inner surface of the catch cup 212 adjacent the exit portion 281, and aid in ensuring the proper positioning the projectiles onto the lip 253 of the feed mechanism 210.

Figure 43:
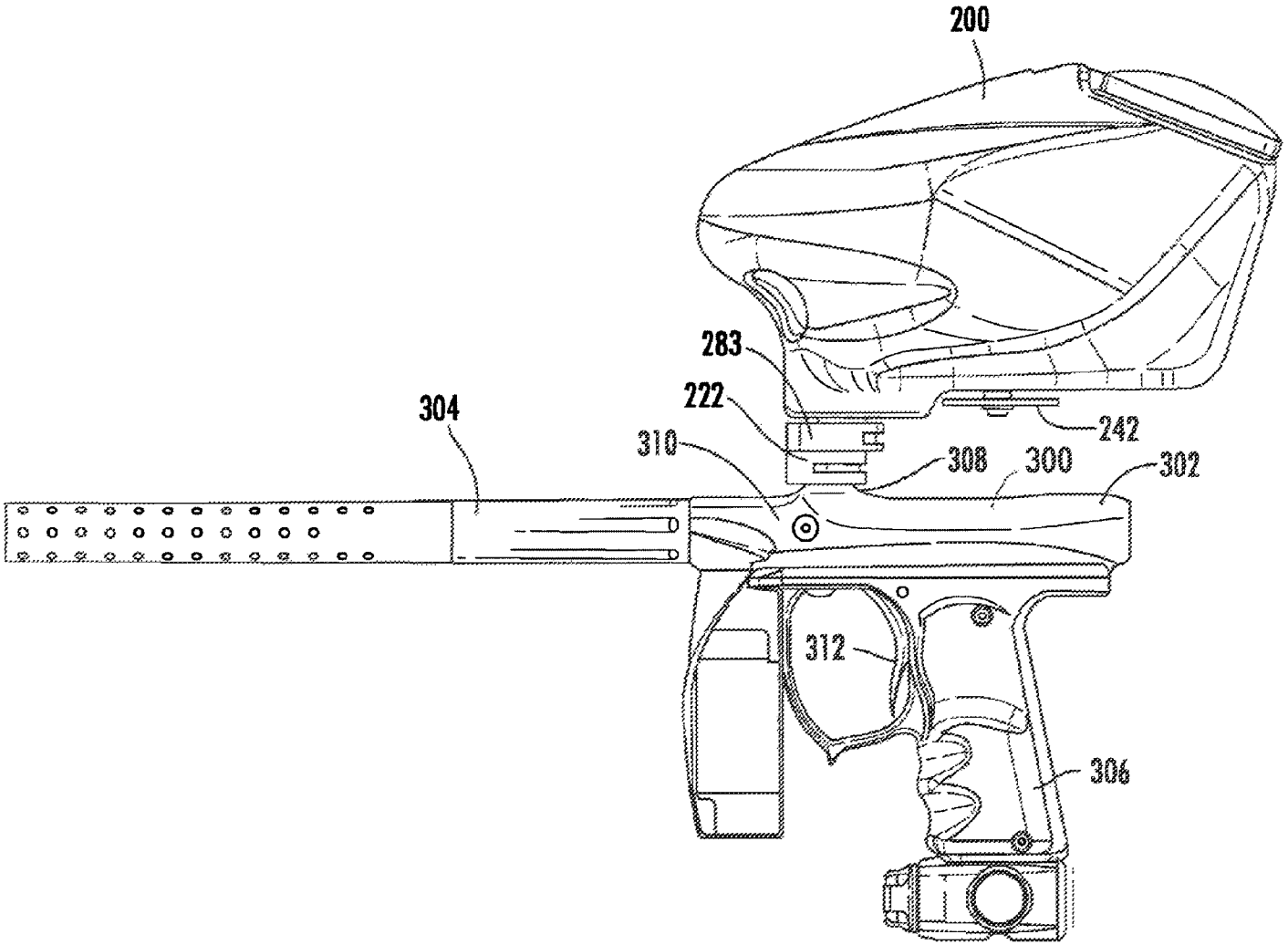
FIG. 43 is a side view of the paintball loader and feed system of the present invention operatively attached to a paintball marker.

FIG. 43 illustrates one embodiment of the integration between the loader 200 and a paintball marker 300. The paintball marker 300 includes a main body 302, a barrel 304, a grip portion 306, an inlet tube 308, a firing chamber 310, and a trigger 312. The marker 300 is adapted it receive compressed gas from a source of compressed gas such as a CO2 or NO2 tank, as is will known in the art. As described above, the projectiles contained in the loader 200 are driven by the feed mechanism 210 into the outfeed tube 222. The outfeed tube 222 is clamped using clamp 283 or other attachment means to the inlet portion 308 of the marker 300. The outfeed tube 222 feeds the projectiles into the inlet portion 308 of a paintball marker 300. From the inlet portion, the projectiles move into the firing chamber (or breech) where they are fired from the marker under the force of compressed gas.

It is envisioned that the above-described cup assembly 201 could be integrated into a loader 200 specifically configured to accept such an assembly, or in an alternate embodiment, may be installed into an existing loader as part of a retrofitted kit. This embodiment would allow a user to enhance the performance of their present loader without requiring the purchase of the entire loader and cup arrangement. In such an arrangement, the cup assembly 201, including the feed mechanism 210, the gearbox 224 and the inlet cup 222 would be placed into the interior of an existing loader, and securely attached thereto.

Figure 33:
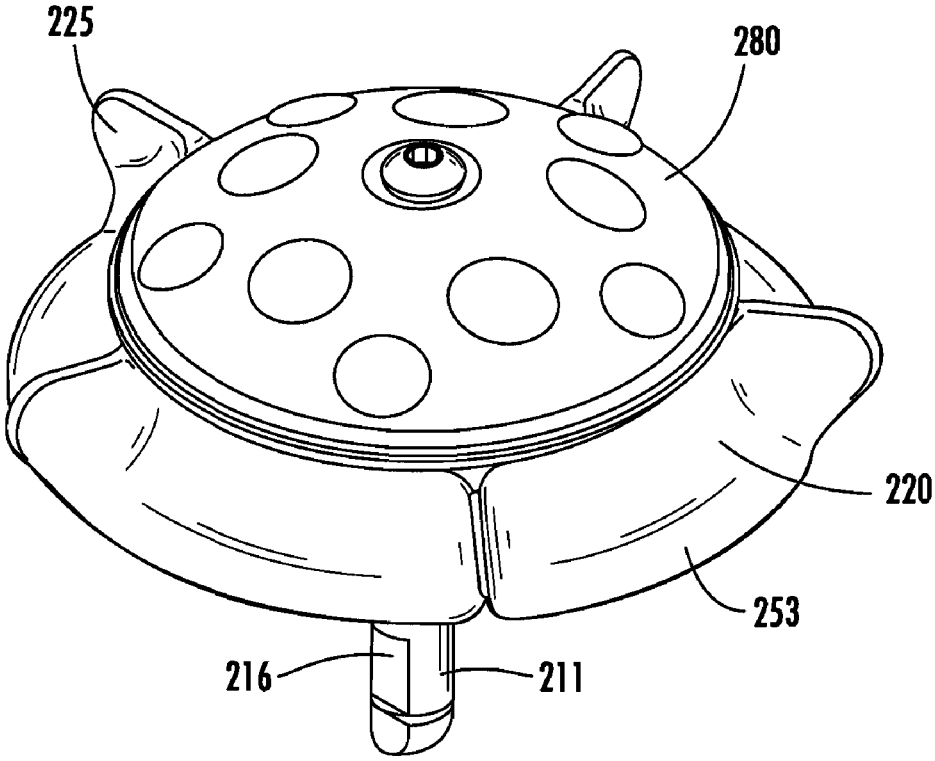
FIG. 33 is an isometric view of the feed mechanism of the present invention.

FIG. 33 is an isometric view of a feed mechanism 210 of the present invention completely assembled. The feed mechanism 210 comprises a feed mechanism carrier or feeder 220 and separate cover 280 that is capable of movement independent of the feeder 220. The feed mechanism 210 shown may be similar in design and operation to the feed assemblies disclosed in U.S. Pat. No. 6,792,933 and U.S. Pat. No. 6,701,907, the entire contents of which are incorporated fully by reference herein, which are used in connection with the well known HALO B® or EMPIRE™ RELOADER™ B paintball loaders. It is noted that the present invention may be used with, in place of, or in addition to any other feeder, feed mechanism, agitator, paddle, wheel or impeller of any kind.

As shown in detail in FIGS. 34-39 and 42 the feed mechanism 210 comprises a shaft 211 which may include a bearing 237, which is coupled to a motor. A first plate 230 is keyed to matingly engage a keyed portion 215 of the drive shaft 211 so that rotation of the drive shaft 211 rotates the first plate 230. The first plate 230 comprises at least one or a plurality of openings 235 that are configured to receive binding elements 250. For example, the openings 235 may receive either magnets, or magnetically attractable inserts. In a preferred embodiment, the openings 235 receive magnets which fit into openings.

Figure 35:
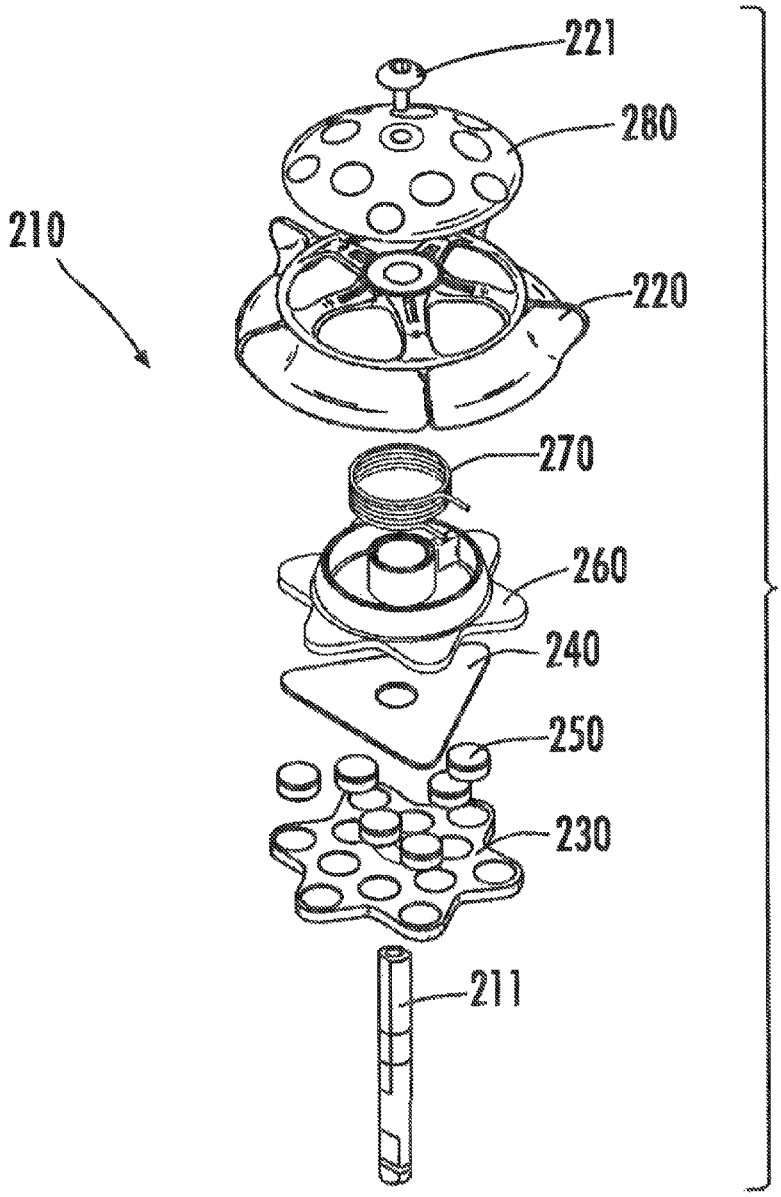
FIG. 35 is another exploded view of the feed mechanism of FIG. 33.
Figure 36:
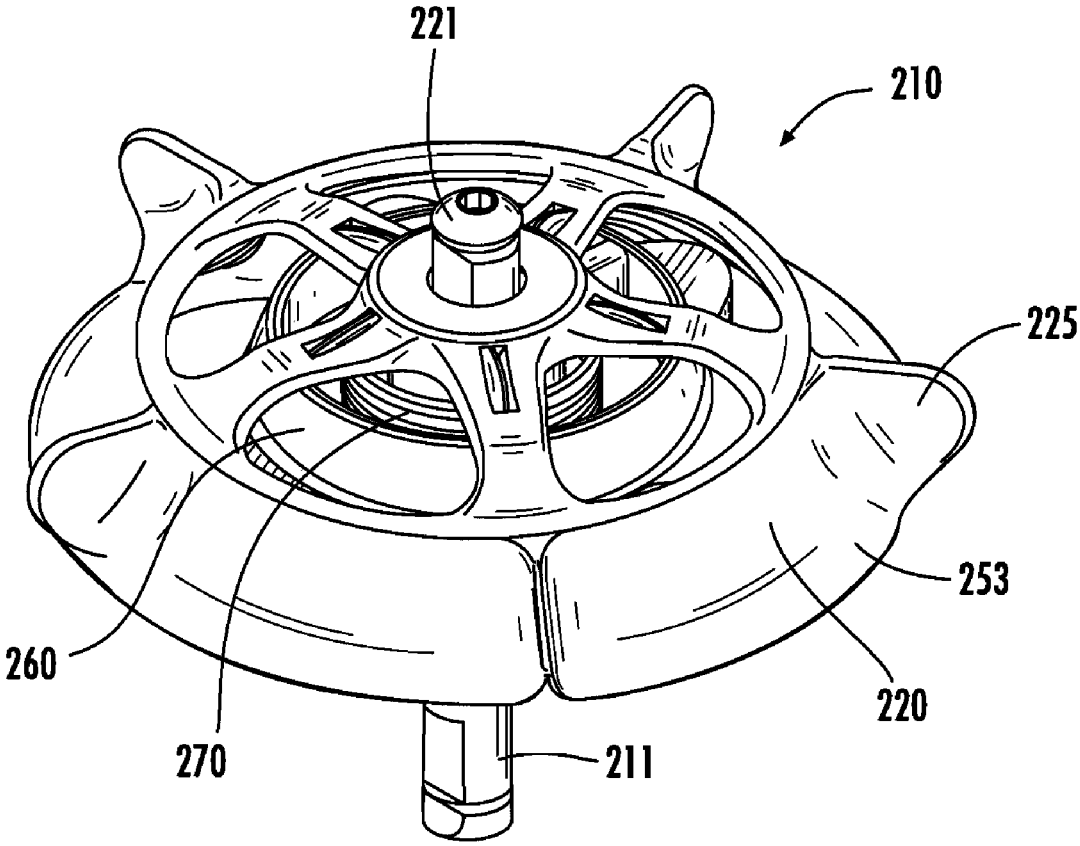
FIG. 36 is an isometric view of the feed mechanism of FIG. 33 shown with its cover removed.
Figure 37:
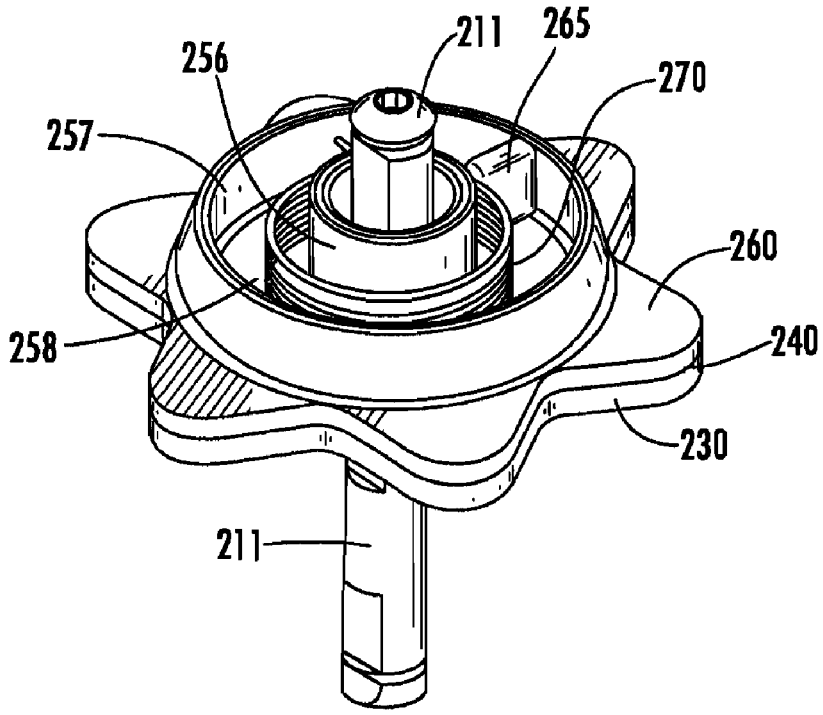
FIG. 37 is an isometric view of the feed mechanism of FIG. 33 shown with its feeder removed, exposing the spring element.
Figure 38:
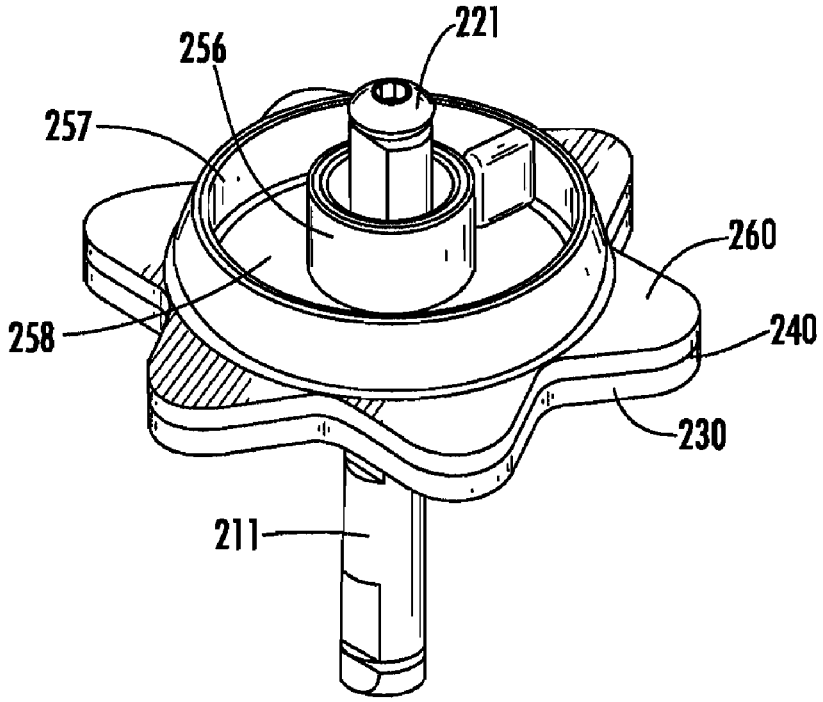
FIG. 38 is an isometric view of the feed mechanism of FIG. 33 shown with its spring removed.
Figure 39:
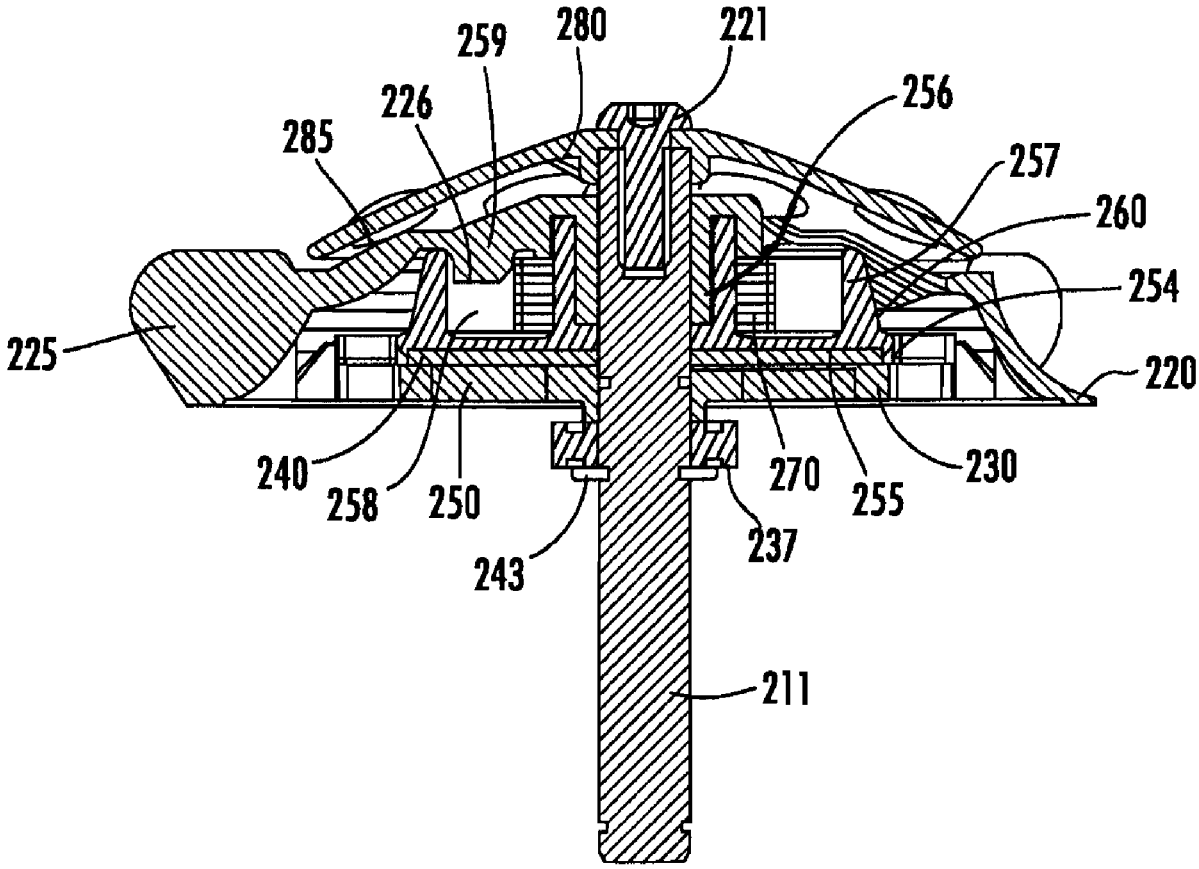
FIG. 39 is a section view of the feed mechanism of FIG. 33

A second plate 240 formed from a magnetically attractable material is positioned about the drive shaft 211 adjacent the first plate 230, and preferably above the first plate 230, as shown in FIG. 35. The second plate 240 is magnetically attractable to the binding elements 250 of the first plate 230, and is preferably formed from a ferrous metal or a magnetic material with a polarity opposite the binding elements 250 so that there is a magnetic attraction between the binding elements 250 and the second plate 240. Moreover, it is noted that any combination of magnetic material, ferrous metal, or other suitable materials may be utilized in either the first or second plates 230, 240 without departing from the scope of the present invention. For example, the binding elements 250 could be magnetically attractable inserts formed of a ferrous metal, and the second plate 240 could be formed from a magnet attractable to the binding elements 250.

Figure 34:
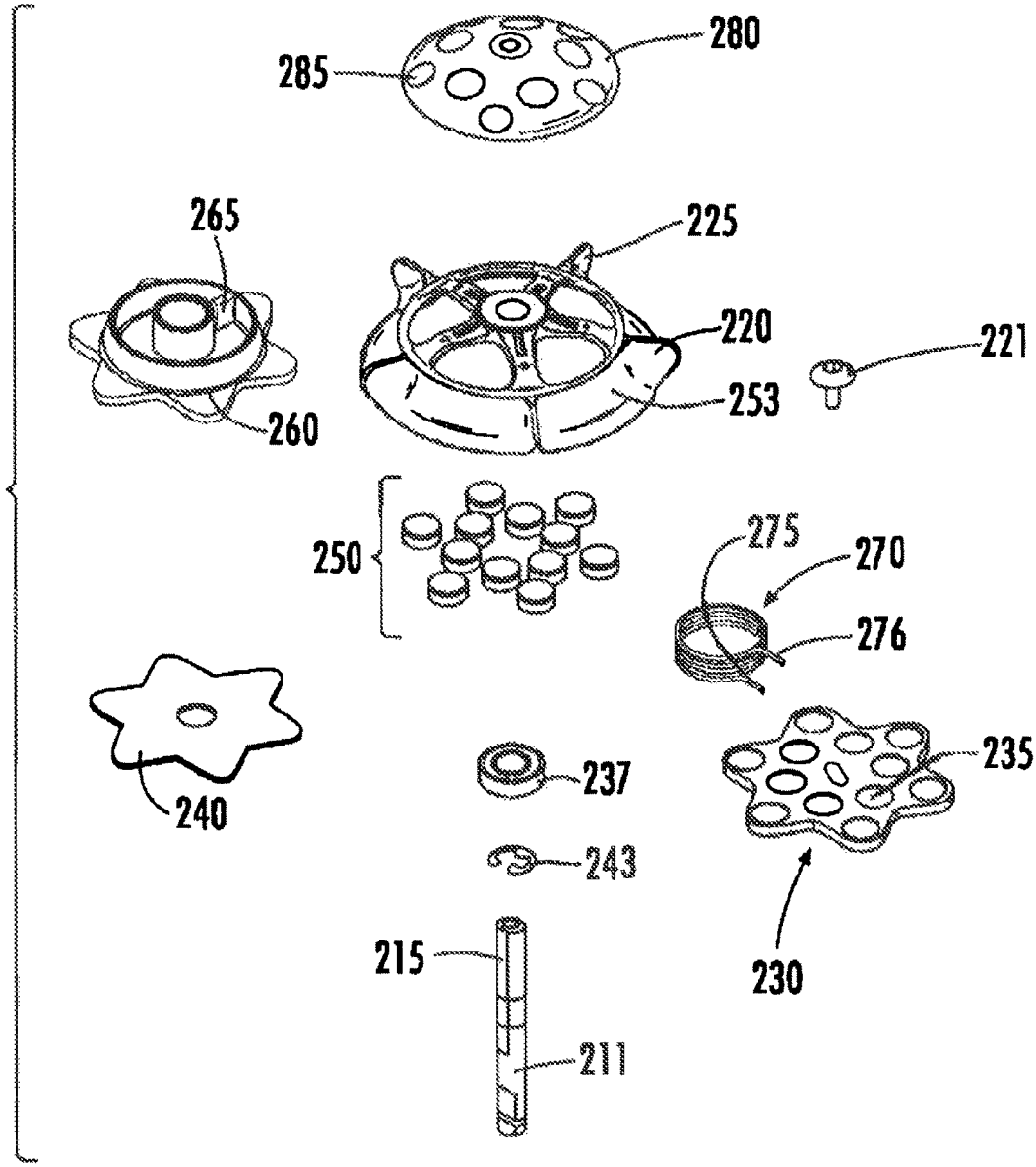
FIG. 34 is an exploded view of the feed mechanism of FIG. 33.
Figure 40:
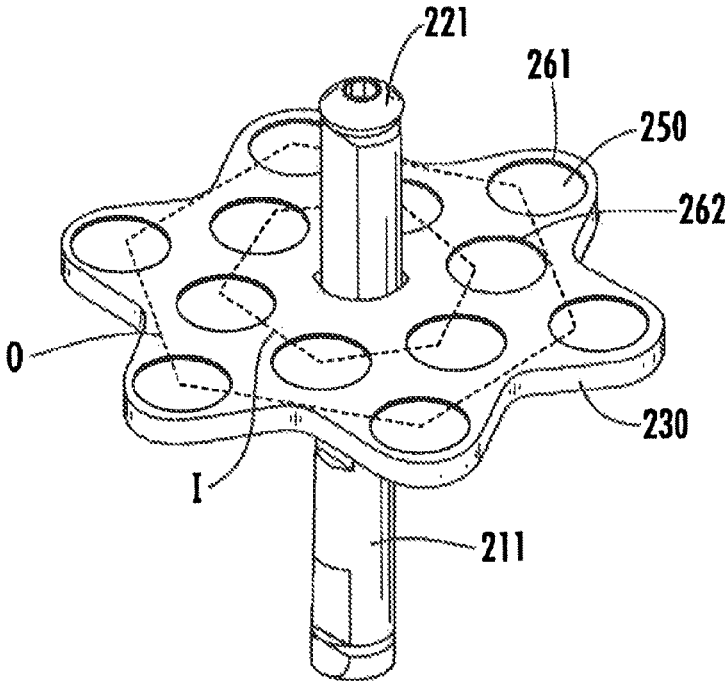
FIG. 40 is an isometric view of an exemplary carrier magnet coupled to a drive shaft.
Figure 41A:
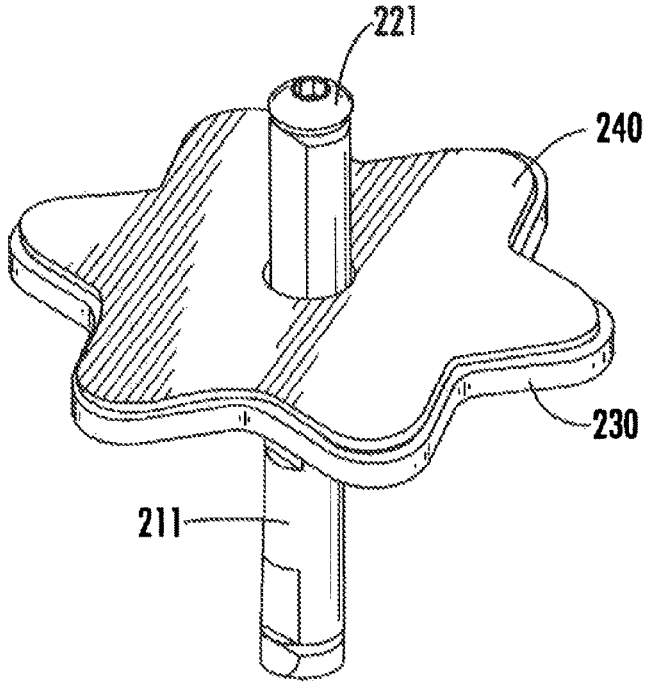
FIGS. 41*a-e* show isometric views of various drive configurations of the feed mechanism of the present invention.

As shown in FIGS. 34-35, the second plate 240 is not keyed to match the keyed portion 215 of the drive shaft 211, and is therefore free to rotate independent of the shaft 211. The second plate 240 may be of any shape. Illustrative shapes are shown in FIGS. 40-42 and will be described in greater detail herein.

A housing 260 is positioned about the drive shaft 211, and is preferably positioned above the second plate 240 as shown in FIG. 35. The housing 260 preferably includes a lower portion 254 having an underside 255 (FIG. 39) with a space configured to receive the second plate 240 such that the housing 260 will rotate when the second plate 240 is rotated by the drive shaft 211. As shown by the Figures, the second plate 240 and the lower portion 254 of the housing 260 have corresponding shapes, such that the second plate mechanically engages the housing 260 when fitted into the space of the underside 255, such that movement of the second plate 240 will move the housing 260.

In one embodiment of the present invention, the housing 260 has an outer annular wall 257 and an inner annular wall 256 forming a receiving area 258 (FIGS. 37-39) configured to receive, for example, a spring 270 or other biasing element. An extension wall 265 positioned within the receiving area 258 of the housing 260 acts as a contact point for one of the ends 275 of the spring 270. The other end 276 of the spring 270 abuts a flange 226 (FIG. 39) extending from a lower portion 259 of the feeder 220. Accordingly, the spring 270 or another biasing member provides may provide biasing force on the feeder 220. The rotational force of the housing 260 will be translated via the spring 270 to the feeder 220.

The first plate 230 acts as a binding element or magnet carrier or holder. The first plate 230 provides for the potential for various configurations of magnets 250 or binding/attraction points. In the illustrative first plate shown in FIG. 40, the first plate 230 has a six-pointed star shape, which six receiving openings 261 adapted to receive magnets at each point of the star shape in an outer configuration, and an inner configuration of six receiving openings 262 adapted to receive magnets.

The second plate 240 is magnetically attracted to the binding elements 250 of the first plate 230. Accordingly, when the drive shaft 211 rotates the first plate 230, the second plate 240 will rotate due to the magnetic attractive force between the plates.

The magnetic attraction force between the binding elements 250 of the first plate 230 and the second plate 240 is, in part, a function of the shape of the second plate 240. Different binding element 250 configurations (such as by selective placement of a selected number of binding elements 250 in selected openings 261, 262 in the first plate 230) and different second plate 240 shapes will interact with differently positioned binding elements 250 to produce different magnetic attraction forces when the drive mechanism of a paintball loader of the present is in operation.

By varying the shape of the second plate 240, the magnetic attractive forces between the binding elements 250 of the first plate 230 and the second plate may be selectively varied. This may vary the "magnetic moment," which is a measure of the torque exerted on a magnetic system (as a bar magnet or dipole) when placed in a magnetic field and that for a magnet is the product of the distance between its poles and the strength of either pole.

The attraction area between the first plate 230 and the second plate 240 can be considered the total area where binding elements 250 can exert a magnetic attraction force on the second plate 230 at a given time. In one embodiment, the second plate 240 as shown in FIG. 41*a*, generally has a similar six-pointed star configuration as the exemplary first plate 230. This six-pointed plate 240, when filled with binding elements, may maximize the magnetic attraction force between the first plate 230 and the second plate, providing the largest attraction area. That is, the magnetic force is maximized as a result of utilizing a plate 240 which incorporating several binding elements 250 over an increased attraction area. As the first plate 230 slips past the second plate 240 (such as when the magnetic attraction force between the binding elements 250 of the first plate 230 and the second plate 240 is overcome by the force of the motor on the drive shaft 211), the binding elements 250 in the outer ring O of the first plate 230 will "release" or "slip," and will again "catch" (come adjacent to and be attracted to) the next point of the second plate after moving through an arc of about sixty degrees. Assuming all holes of the outer ring O are filled with binding elements, the first plate 230 and the second plate 240 will have the greatest attraction area each about sixty degrees of rotation of the first plate 230 relative to the second plate 240, with an attraction between all points of the star shapes of the plates 230, 240.

Figure 41B:
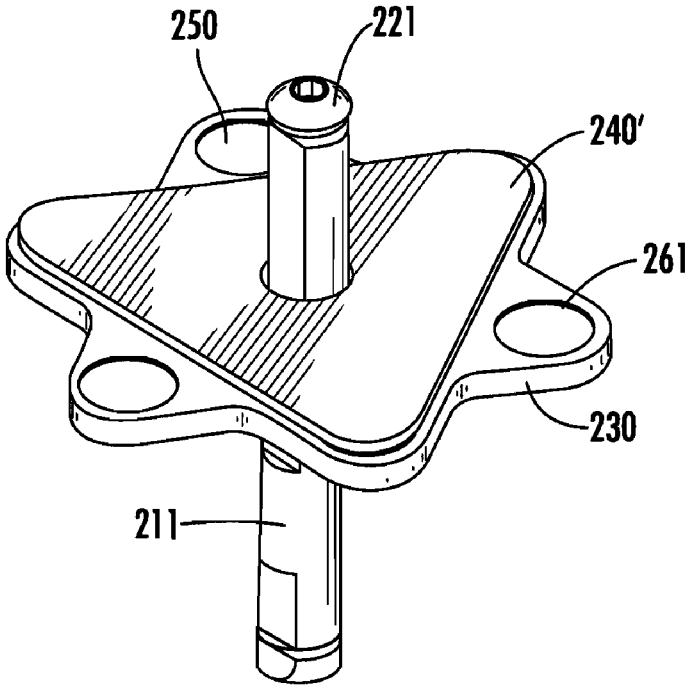
Figure 42:
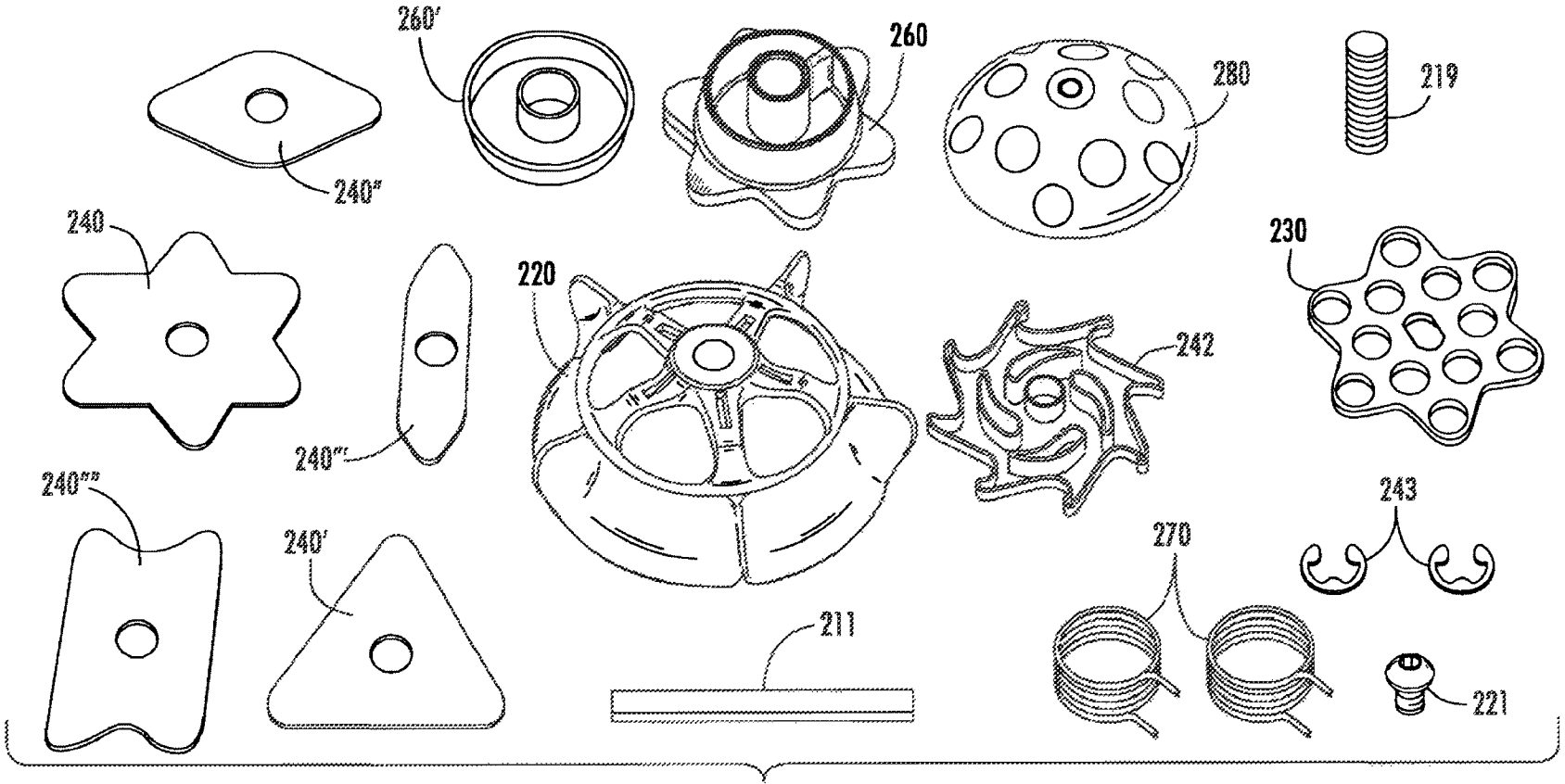
FIG. 42 is a plain view of a kit for a drive mechanism of the present invention, including interchangeable drive components.

Another exemplary plate 240', shown in FIG. 41*b*, is generally triangular in shape, and therefore the attraction area is reduced as a result of the plate 240' configured to be positioned adjacent less binding elements 250 when the first plate 230 is in position holding (through magnetic force) the second plate 240, in this example, with three binding elements 250 of the outer ring O adjacent the points of the triangular shape at a time. When the first plate 230 releases the second plate 240 or slips, the first plate 230 will travel along an arc of sixty (60) degrees before a next binding element 250 of the outer ring O is adjacent a point of the triangle of the second plate 240' in the case of binding elements 250 being inserted into every hole 261 (as shown in FIG. 41*b*), or through an arc of about one-hundred and twenty (120) degrees, if the every other hole 261 of the outer ring O is left empty.

It is appreciated that exemplary shaped second plates 240 and 240' have central portions that will remain adjacent any binding elements 250 of the inner ring portion I of the first plate 230, even as the binding elements 250 of the outer ring portion O release or slip. Thus, the binding elements 250 of the inner ring portion I provide a substantially continuous magnetic attraction force between the first plate 230 and the second plate 240, even as the first plate 230 moves relative to the second plate 240.

Figure 41C:
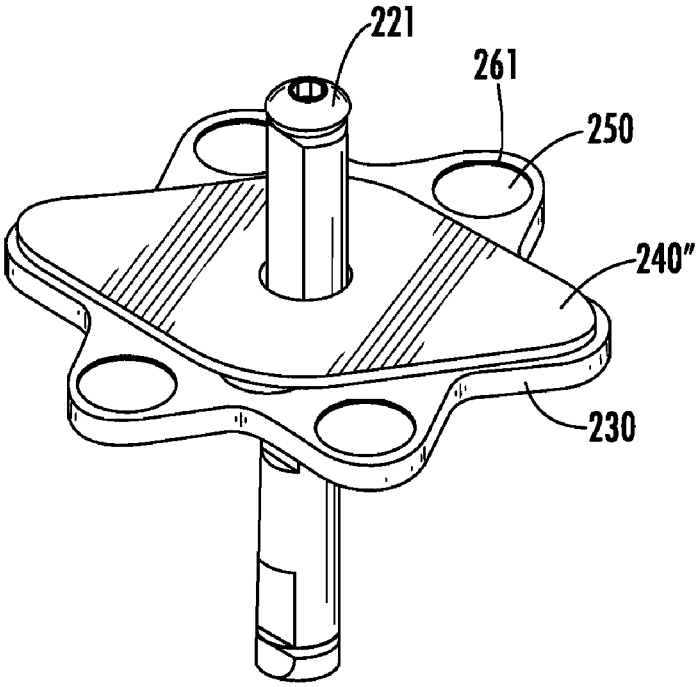

Exemplary plate 240" shown in FIG. 41*c* has an elliptical shape and provides two portions attractable to binding elements 250 of the outer ring portion O, as well as a central portion that is attractable to at least some of the binding elements 250 of the inner ring portion I. This configuration provides less of an attraction area than the arrangement described in FIG. 41*b* as a result of additional holes 261 or binding elements 250 positioned non-adjacent the plate 240". The arc distance that the first plate 230 travels through between magnetic "slips" and magnetic "catches" may be varied between about sixty (60) degrees, and about one-hundred eighty (180) degrees, depending on the placement of the binding elements 250.

Figure 41D:
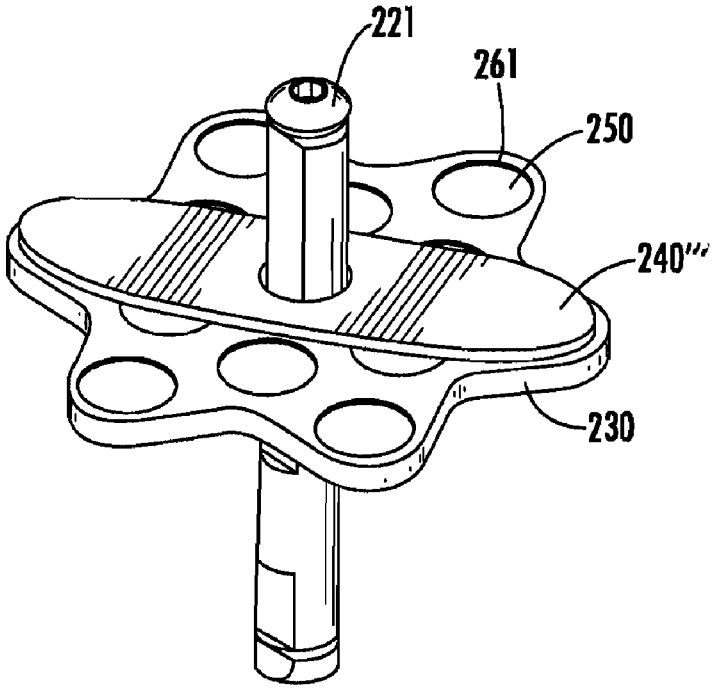

The exemplary plate 240''' shown in FIG. 41*d* has an elliptical or oblong shape will a thinner central portion than the plate 240" shown in FIG. 41*c*, and will come adjacent two of the magnets 250 of the outer ring O and portions of four (4) magnets 250 of the inner ring I, resulting in a further reduction of the attraction area between the plates 240''' and 230 compared to the previously described configurations. As indicated above, the arc distance that the first plate 230 may travel before binding elements 250 of the outer ring O come adjacent the points or ends of the second plate 240''' may be between about sixty (60) degrees and about one-hundred and eighty (180) degrees, depending on binding elements placement 250. For example, if only one binding element 250 is placed in one opening 261 of the outer ring O, the first plate 230 may rotate through an arc of about one-hundred eighty degrees to its original position before the one binding element 250 is brought adjacent a point or end of the second plate 240'''.

Figure 41E:
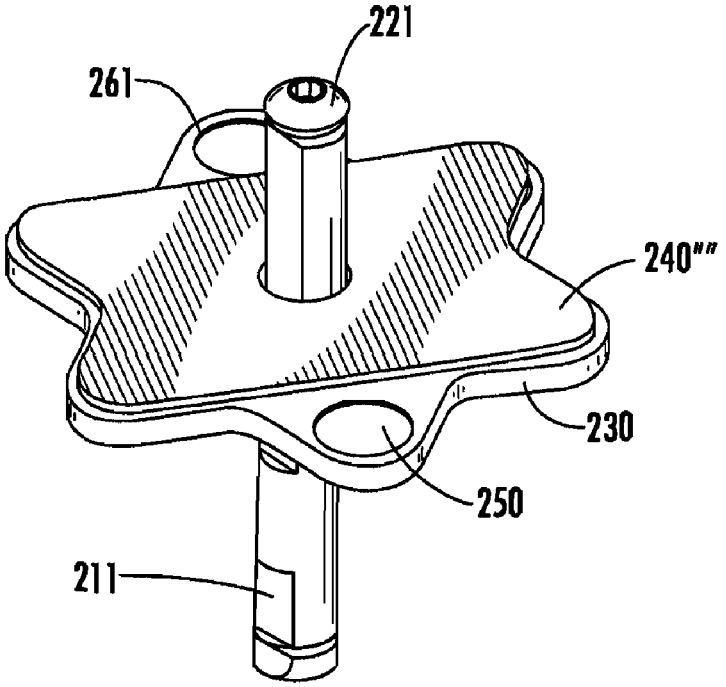

Finally, the exemplary plate 240'''' of FIG. 41*e* has an irregular shape having four end points or "points," and configured to match the contour of the first plate 230 end with the points adjacent all but two (2) of the magnets 250 of the outer ring O.

It should be appreciated that any shaped upper or lower plates 240, 230 may be utilized in combination with any arrangement of the binding elements 250 in order to achieve a desired attraction area or various magnetic forces through the magnetically attractive elements of the first plate and the second plate. It is also appreciated that the first plate may be formed as a magnet having a particular shape, or with magnets pre-formed and set in pre-selected positions.

The drive mechanism of the present invention operates as a slip clutch for a paintball loader, providing a force for feeding paintballs to a paintball marker, while "slipping" to prevent paintball breakages. When a paintball loader including the drive mechanism of the present invention is coupled to a paintball marker, a user will fire the paintball marker, which will shoot a paintball from the marker. The marker will require constant replenishing of paintballs supplied by the paintball loader.

In operation, when a paintball marker requires more paintballs, the sensor 252 and/or controller 207 may signal the motor 226 to operate to rotate the drive shaft 211. The drive shaft 211 will in turn rotate the first plate 230 which engages the drive shaft 211 at the keyed portion 215. The magnets 250 of the first plate will exert a magnetic attractive force on the second plate 240. Thus, rotation of the first plate 230 will rotate the second plate 240 via magnetic force.

The second plate 240 is coupled to the housing 260. Rotation of the second plate 260 will rotate the housing 260. This will wind the spring 270, and a biasing force will be translated via the spring 270 to the feeder 220. The feeder will rotate under the biasing force of the spring 270.

During operation, a paintball marker may cease firing, and a line of paintballs or a "paintball stack" may form in the outfeed tube 222 of the paintball loader. The motor 226 of the present invention can be set to continue to rotate, even though there is a stationary paintball stack. A fin 225 of the feeder 220 will contact a stationary paintball. The housing 260 may continue to turn, thus winding the spring 270 and creating increased tension spring and potential energy. The feeder 220 will then be forced by spring tension against the paintball stack, and will provide a driving force on the paintball stack for immediate feeding when a user again fires the paintball marker, and the paintball marker requires additional paintballs fed from the loader. When the paintball stack moves through the outfeed tube 222, the spring tension and potential energy may be released by movement of the feeder 220.

The present invention provides a means for operation of the drive mechanism that provides for the application of force on the paintballs that may be continuous, near continuous or intermittent, while also providing for a slip clutch that prevents paintball breaks due to the application of too much force. The motor 226 may wind the spring 270 to a point where the spring 270 may provide a force on the feeder 220 that will provide a force on a paintball stack that could break a paintball, or otherwise break a paintball within the loader. The magnetic slip clutch of the present invention operates to prevent such breakages. When the housing is turned to a certain degree (a degree which can be adjusted by a user, set by the controller or otherwise varied), the force of the drive shaft 211 on the first plate 230 will be greater than the magnetic force between the binding elements 250 of the first plate 230 and the second plate 240. In that case, the drive shaft 211 will rotate the first plate 230 so that the first plate "releases" or "slips" from its magnetic engagement of the second plate 240, that is, the magnetic attractive force cannot hold the first plate 230 and second plate 240 in the same orientation as to each other. After slipping, the binding elements 250 will again "catch" and exert a magnetic attractive force on the second plate 240 each time the binding elements 250 are adjacent a portion of the second plate 240.

A user of a paintball loader of the present invention can select the configuration of magnets to meet the needs and operation of the user and the user's paintball marker. A variety of configurations of magnets 250 placed in the openings 235 of the first plate 230 provide a highly "tunable" coupling capable of varying the amount of force transferred to the second plate, and thus, the feeder 220. An inner ring I is arranged for a maximum of six (6) magnets, in an embodiment, to provide a total holding force up to a point past total spring wind. After a slip occurs the magnets 250 may hold and not allow the feed mechanism's spring 270 to unwind. An outer, non-continuous binding configuration O provides extra force to be maintained. Once a slip is achieved, the holding force of the outer binding points 235*o* is released. The inner binding points 235*i* which remain adjacent a portion of the second plate 240 at all times, will continue to exert a force to prevent unwinding of the feed spring 270.

Various degrees of magnetic attraction or attraction areas can be achieved by the placement of magnets or binding elements 250 in the openings 253 of the outer ring O of the second plate 230. Openings 235 receive magnets 250, which, depending on the number and placement of the magnets 250, will determine the amount of attractive force and attraction area between the first and second plates 230, 240. Additional or varied attractive/holding forces can be achieved by moving magnets 250 further from center, adding multiple magnets 250 around the same circumference, and stacking magnets 250 to create a stronger field for a given binding area. By increasing attraction force, more rotational force is needed to overcome such attractive forces. The magnetic attractive force can be increased to complete motor stall which is the operational mechanical force limit of any feeding device.

The housing 260 is rotated by movement of the second plate 240 resulting from magnetic attraction with the binding elements 250 of the first plate 230 that is in coupled rotation with the drive shaft 211. The arrangement of the first plate 230, which carries binding elements 250, with the second plate 240, which is integral in rotation with the housing 260, acts a magnetic clutch or magnetic slip clutch. It is appreciated that the present invention could operate without the need for using a spring, in which case, the housing could be a part of or otherwise contact the feeder such that the feeder moves when the housing is rotated.

As described above, the "slipping" of the magnetic clutch of the present invention can be adjusted by using fewer magnets 250 in the outer ring I in relation to how many potential contact points the various second plates 240, 240', 240", 240''', 240'''' may comprise. In a first exemplary arrangement, six magnets 250 are placed in the outer ring O of the first plate 230. If the second plate 240 (six-pointed) is used, there would be a high "slip" frequency. The magnetic force would release quickly, followed by a fast recovery at the next point.

In an alternate illustrative arrangement, if the number of outer ring O magnets 250 was reduced to three (3), the hold force would decrease, however, the frequency would be the same due to the six-pointed plate 240 being deployed. However, in a further illustrative arrangement, if the second plate used is the three-pointed plate 240' of FIG. 41*b*, the frequency is reduced by one-half for any given rotation. Adjusting frequency of the force application allows the drive system to run very easy due to the motor being allowed to run up to speed before encountering the next "slip moment". For comparison's sake, if the number of inner ring I magnets 250 is reduced, thereby decreasing the overall continuous holding power, then the slipping effect becomes more apparent.

Feed mechanisms are sometimes inefficient when a loader is over-loaded or balls are misaligned due to the weight of the balls directly on top of the feeder. Since the top feed surface or cover 280 of the present invention is separate from the feeder 220, the weight is borne by the cover 280 and does not weigh on the feeder 220. The cover 280 is keyed to the top of the drive shaft 211 and held in place by a standard retaining screw 221. The cover 280 is preferably in coupled rotation with the drive shaft 211. Therefore, the feeder 220 does not bear the weight of the paintballs in the loader.

The feed mechanism 210 rotates independently by the spring forces applied to it through the housing 260. Without the extra weight of the balls being directly on top of the feeder 220, the feed mechanism 210 operates much more efficiently. It responds quicker and is more efficient for a given amount of spring pressure.

This separated top surface or cover 280 can be used to enhance any feed system using a paddle, drive cone or other type of agitator. The top cone 280 also provides protection from contaminates entering the mechanics of the feed mechanism area.

The cover 280 can comprise selective raised or dimpled surfaces 285 to allow for agitation of the balls resting on top. The raised surfaces can be in the form of ribs, bumps, dimples, nubs, undulations, etc. In the embodiment shown, the cover 280 comprises bumps 285. The bumps 285 allow the balls to be contacted from a variety of orientations allowing them to fluidize more efficiently.

The separate top feeding surface, or feeder cap 280, ensures that weight from over loading or misaligned balls does not affect the feeder 220 which rotates independently. The cap 280 is keyed to a keyed portion 115 of the drive shaft 211 and is in coupled rotation with it. Furthermore, the separated top feeding surface or cap 280 also provides agitation independent of the feeder 220 since it does not necessarily rotate with the feeder 220. Since the weight of the paintballs is borne by the cap 280, the feeder 220 responds more quickly due to the lack of weight it has to overcome.

The separate feeder cap 280 can be utilized with or without a clutch mechanism and can comprise various types of bumps or ridges 285 to provide agitation in multiple directions.

Figure 44:
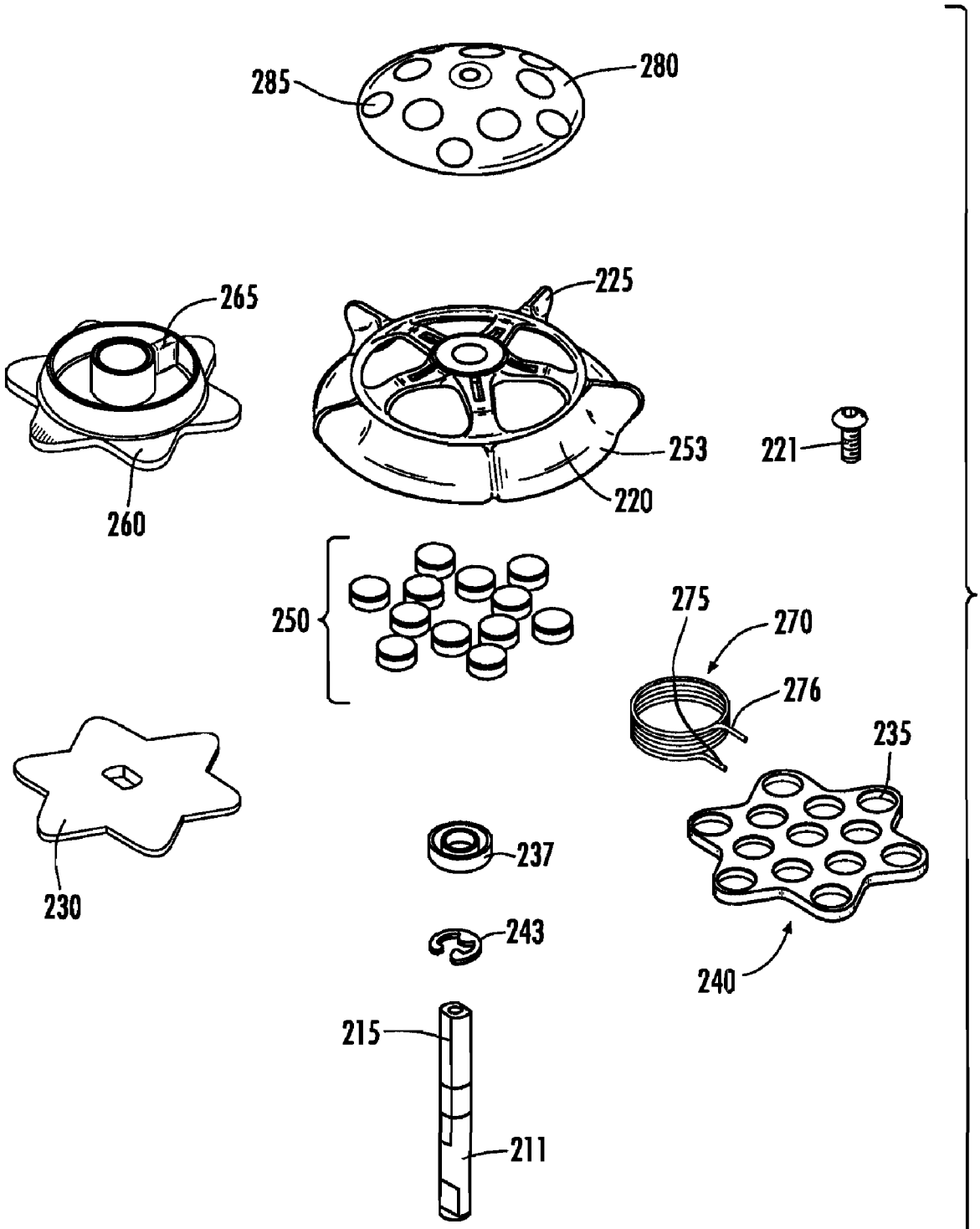
FIG. 44 is an exploded view of an alternate embodiment of the drive assembly of the feed mechanism of the present invention.

It is appreciated that the second plate 240, in addition to or in an alternative to the first plate 230, maybe provided with openings 235 for receiving binding elements 250, and the first plate 230 may be formed being magnetically attractable to the binding elements of the second plate 240. Accordingly, as shown in FIG. 44, the first plate 230 may be formed as a magnetically attractable plate or having a magnetically attractable portion formed from, for example, a ferrous metal. The second plate 240 includes at least one or a plurality of openings 235 for receiving at least one or a selected number of binding elements 250. The operation and selectable tuning of the magnetic clutch system would be as previously described, with the user selecting positions for placing binding elements 250 in the openings of the second plate 240. The first plate 230 could be of any shape as the second plate as shown by the examples of FIGS. 41*a* through 41*e*.

FIG. 42 shows the components of a kit 285 that can be offered to modify an existing paintball loader that does not have a drive mechanism of the present invention. Such a kit 285 may include one or more first plates 230, one or more second plates 240 of various configurations, a housing 260 or 260', a wheel 242, replacement springs 270, a feeder 220, a cap 280, a drive shaft 211, a screw 221, clips 243, or any combination of the foregoing.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all other embodiments and changes to these embodiments which come within the meaning and range of equivalency of said claims are therefore to be embraced therein.

What is claimed is:

1. A paintball marker and paintball loader combination, comprising:

a paintball marker for firing paintballs using compressed gas;

a paintball loader in communication with the paintball marker having a drive mechanism, the drive mechanism comprising:

a drive shaft;

a motor for rotating the drive shaft;

a first plate rotatably attached to the drive shaft and rotatable with the drive shaft;

a second plate positioned about the drive shaft adjacent the first plate, the second plate rotatable about the drive shaft independent of the movement of the drive shaft, the second plate having a magnetically attractable portion;

the first plate including openings for receiving at least one magnet at a user selectable position;

a feeder positioned about the drive shaft and rotatable about the drive shaft independent of the movement of the drive shaft; and, a housing positioned about the drive shaft and rotatable independently of the drive shaft, the housing including an opening shaped to correspond to a shape of the second plate, the housing configured to move with the second plate, the housing configured to translate movement of the second plate to the feeder.

2. The paintball marker and paintball loader of claim 1, further comprising a sensor in communication with the motor.

3. The paintball marker and paintball loader of claim 2, further comprising a controller in communication with the sensor and the motor.

4. The paintball marker and paintball loader of claim 1, further comprising a cap positioned adjacent the feeder, the cap including at least one protrusion extending therefrom, the cap coupled to the drive shaft and configured to rotate with the drive shaft.

5. The paintball marker and paintball loader of claim 1, wherein the second plate has a shape selected from the group of a star, a triangle, an ellipse, and an oblong.

6. The paintball marker and paintball loader of claim 1, wherein the housing includes a receiving space adjacent the feeder, further comprising a spring at least partially within the receiving space, the spring coupling the housing to the feeder.

7. A paintball loader, comprising:

a body including an opening for receiving at least one paintball;

an outfeed tube in communication with the opening and configured to feed paintballs to a paintball marker;

a drive shaft;

a motor for rotating the drive shaft;

a first plate rotatably attached to the drive shaft and rotatable with the drive shaft;

a second plate positioned about the drive shaft adjacent the first plate, the second plate rotatable about the drive shaft independent of the movement of the drive shaft, the second plate having a magnetically attractable portion;

the first plate including openings for receiving at least one magnet at a user selectable position;

a feeder positioned about the drive shaft and rotatable about the drive shaft independent of the movement of the drive shaft; and, a housing positioned about the drive shaft and rotatable independently of the drive shaft, the housing including an opening shaped to correspond to a shape of the second plate, the housing configured to move with the second plate the housing configured to translate movement of the second plate to the feeder.

8. The paintball loader of claim 7, further comprising a sensor in communication with the motor.

9. The paintball loader of claim 8, further comprising a controller in communication with the sensor and the motor.

10. The paintball marker and paintball loader of claim 7, further comprising a cap positioned adjacent the feeder, the cap including at least one protrusion extending therefrom, the cap coupled to the drive shaft and configured to rotate with the drive shaft.

11. The paintball marker and paintball loader of claim 7, wherein the second plate has a shape selected from the group of a star, a triangle, an ellipse, and an oblong.

12. The paintball marker and paintball loader of claim 7, wherein the housing includes a receiving space adjacent the feeder, further comprising a spring at least partially within the receiving space, the spring coupling the housing to the feeder.

13. A method for driving projectiles in a projectile loader comprising the steps of:

a) providing a projectile loader having a body defining an opening for receiving paintballs, the paintball loader including a drive shaft;

b) providing a first plate and a second plate on the drive shaft, the first plate positioned adjacent the second plate, the first plate and second plate magnetically attractable to each other, wherein the first plate is rotatable with the drive shaft and wherein the second plate is rotatable independent of the drive shaft, one of the first plate or the second plate including a plurality of openings for receiving magnets in user selected positions;

c) selectively placing magnets within the openings to create a user-selected attraction area;

d) providing a housing positioned about the drive shaft and rotatable independently of the drive shaft, the housing positioned between the second plate and the feeder, the housing including an opening shaped to receive the second plate, the housing configured to move with the second plate, the housing configured to translate movement of the second plate to the feeder;

e) providing a motor for rotating the drive shaft; and, f) operating the motor.

14. A paintball loader, comprising:

a body including an opening for receiving at least one paintball;

an outfeed tube in communication with the opening and configured to feed paintballs to a paintball marker;

a drive shaft;

a motor for rotating the drive shaft;

a first plate rotatably attached to the drive shaft and rotatable with the drive shaft;

a second plate positioned about the drive shaft adjacent the first plate, the second plate rotatable about the drive shaft independent of the movement of the drive shaft;

at least one of the first plate or the second plate including a magnetically attractable portion;

the other of the first plate or the second plate including at least one opening for receiving at least one magnet;

a feeder positioned about the drive shaft and rotatable about the drive shaft independent of the movement of the drive shaft;

a housing positioned about the drive shaft and rotatable independently of the drive shaft, the housing configured to move in coordination with one of the first plate or the second plate, the housing configured to translate movement of the plate with which the housing moves to the feeder.

* * * * *